US011257435B2

(12) United States Patent
Kim et al.

(10) Patent No.: US 11,257,435 B2
(45) Date of Patent: Feb. 22, 2022

(54) DISPLAY APPARATUS AND METHOD OF DRIVING DISPLAY PANEL USING THE SAME

(71) Applicant: Samsung Display Co., Ltd., Yongin-Si (KR)

(72) Inventors: HongSoo Kim, Hwaseong-si (KR); Sehyuk Park, Seongnam-si (KR); Sangan Kwon, Cheonan-si (KR); Jinyoung Roh, Hwaseong-si (KR); Sukhun Lee, Suwon-si (KR); Hyojin Lee, Yongin-si (KR); Junheyung Jung, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/931,509

(22) Filed: Jul. 17, 2020

(65) Prior Publication Data

US 2021/0043143 A1 Feb. 11, 2021

(30) Foreign Application Priority Data

Aug. 8, 2019 (KR) ..... 10-2019-0096566

(51) Int. Cl.
*G09G 5/10* (2006.01)
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2320/0247* (2013.01);
(Continued)

(58) Field of Classification Search
CPC ..... G09G 3/3258; G09G 3/3291; G09G 2320/0247; G09G 2320/0626;
(Continued)

(56) References Cited

U.S. PATENT DOCUMENTS

2010/0020112 A1* 1/2010 Jeon ..... G09G 3/3648 345/690
2015/0340014 A1* 11/2015 Kim ..... G09G 5/10 345/212
(Continued)

FOREIGN PATENT DOCUMENTS

KR 10-1030544 B1 4/2011
KR 10-2015-0057851 A 5/2015
(Continued)

*Primary Examiner* — Jennifer T Nguyen
(74) *Attorney, Agent, or Firm* — Innovation Counsel LLP

(57) ABSTRACT

A display apparatus includes a display panel, a gate driver, a data driver, and a driving controller. The display panel displays an image based on input image data. The gate driver outputs a gate signal to the display panel. The data driver outputs a data voltage to the display panel. The driving controller selectively determines a driving mode of the display apparatus between one of a normal driving mode and a low frequency driving mode, and determines a driving frequency of the display panel based on the input image data. The driving controller includes a flicker value storage storing flicker values for grayscale values of the input image data and a data remapper converting the grayscale value of the input image data to decrease a size of a maximum frequency grayscale area corresponding to a maximum driving frequency in the low frequency driving mode.

20 Claims, 18 Drawing Sheets

(52) U.S. Cl.
CPC ..... *G09G 2320/0626* (2013.01); *G09G 2320/0673* (2013.01)

(58) Field of Classification Search
CPC ..... G09G 2320/0673; G09G 2330/021; G09G 2310/027; G09G 2310/08
USPC ..... 345/694
See application file for complete search history.

(56) References Cited

U.S. PATENT DOCUMENTS

| | | | | |
|---|---|---|---|---|
| 2017/0011692 | A1* | 1/2017 | Lee | G09G 3/3233 |
| 2017/0132964 | A1* | 5/2017 | Lee | G09G 5/18 |

FOREIGN PATENT DOCUMENTS

| | | | |
|---|---|---|---|
| KR | 10-1544843 | B1 | 8/2015 |
| KR | 10-2018-0032256 | A | 3/2018 |

* cited by examiner

FIG. 4

| STAGE | INPUT GRAYSCALE(8bit) | FLICKER VALUE | FREQUENCY(Hz) |
|---|---|---|---|
| 1 | 0-3 | 0 | 1 |
| 2 | 4-7 | 0 | 1 |
| 3 | 8-11 | 40 | 2 |
| 4 | 12-15 | 80 | 5 |
| 5 | 16-19 | 120 | 10 |
| 6 | 20-23 | 160 | 30 |
| 7 | 24-27 | 200 | 60 |
| ⋮ | · | ⋮ | · |
| 60 | 236-239 | 0 | 1 |
| 61 | 240-243 | 0 | 1 |
| 62 | 244-247 | 0 | 1 |
| 63 | 248-251 | 0 | 1 |
| 64 | 252-255 | 0 | 1 |

FIG. 11

| INPUT GRAYSCALE | OUTPUT GRAYSCALE |
|---|---|
| 12 | 12 |
| 13 | 12.5 |
| 14 | 13 |
| 15 | 13.5 |
| 16 | 14 |
| 17 | 15.25 |
| 18 | 16.5 |
| 19 | 17 75 |
| 20 | 19 |
| 21 | 20.25 |
| 22 | 21.5 |
| 23 | 22.75 |
| 24 | 24 |
| 25 | 25.25 |
| 26 | 26.5 |
| 27 | 27.75 |
| 28 | 29 |
| 29 | 30.25 |
| 30 | 31.5 |
| 31 | 32.75 |
| 32 | 34 |
| 33 | 34.5 |
| 34 | 35 |
| 35 | 35.5 |
| 36 | 36 |

| INPUT GRAYSCALE | OUTPUT GRAYSCALE |
|---|---|
| 97.0 | 88.1 |
| 98.0 | 89.1 |
| 99.0 | 90.1 |
| 100.0 | 91 1 |
| 101.0 | 92.1 |
| 102.0 | 93.1 |
| 103.0 | 94.1 |
| 104.0 | 95.1 |
| 105.0 | 96.1 |
| 106.0 | 97 1 |
| 107.0 | 98.1 |

DISPLAY APPARATUS AND METHOD OF DRIVING DISPLAY PANEL USING THE SAME

PRIORITY STATEMENT

This application claims priority under 35 U.S.C. § 119 to Korean Patent Application No. 10-2019-0096566, filed on Aug. 8, 2019 in the Korean Intellectual Property Office KIPO, the contents of which are herein incorporated by reference in their entireties.

BACKGROUND

1. Field

The present disclosure relates to a display apparatus and a method of driving a display panel using the display apparatus. More particularly, the present disclosure relates to a display apparatus reducing power consumption and a method of driving a display panel using the display apparatus.

2. Description of the Related Art

A display apparatus and a method of using the same to minimize power consumption of electronic devices such as a tablet PC and a note PC have been studied.

To minimize the power consumption of the electronic device which contains a display panel, power consumption of the display panel must be minimized. When the display panel displays a still image, the display panel may be driven in a relatively low frequency so that power consumption of the display panel may be reduced.

However, when the display panel is driven in the relatively low frequency, flicker effect may be generated so that display quality may decrease. Thus, to prevent flicker effect, some of the images may be driven in a high driving frequency so that power consumption cannot be sufficiently achieved in this case. Therefore, a novel and improved way to reduce power consumption and enhance a display quality is, therefore, needed

SUMMARY

The present disclosure provides a display apparatus capable of reducing power consumption.

The present disclosure also provides a method of driving a display panel using the display apparatus.

In an example embodiment of a display apparatus according to the present disclosure, the display apparatus includes a display panel, a gate driver, a data driver, and a driving controller. The display panel is configured to display an image based on input image data. The gate driver is configured to output a gate signal to the display panel. The data driver is configured to output a data voltage to the display panel. The driving controller is configured to control an operation of the gate driver and an operation of the data driver, to selectively determine a driving mode of the display apparatus between a normal driving mode and a low frequency driving mode, and to determine a driving frequency of the display panel based on the input image data. The driving controller includes a flicker value storage configured to store flicker values for grayscale values of the input image data and a data remapper configured to convert the grayscale value of the input image data to decrease a size of a maximum frequency grayscale area corresponding to a maximum driving frequency in the low frequency driving mode.

In an example embodiment, the driving controller may further include a still image determiner configured to determine whether the input image data is a still image or a video image based on the input image data, and configured to generate a flag representing whether the input image data is the still image or the video image, and a driving frequency determiner configured to determine the driving mode of the display apparatus between the normal driving mode and the low frequency driving mode based on the flag, and configured to determine the driving frequency of the display panel using the flicker value storage.

In an example embodiment, the data remapper may be configured to convert the grayscale value of the input image data when the input image data is the still image. The data remapper may be configured not to convert the grayscale value of the input image data when the input image data is the video image.

In an example embodiment, the data remapper may include a data remapping lookup table configured to generate a converted grayscale value by multiplying a converting gain to the grayscale value of the input image data.

In an example embodiment, the flicker value storage and the data remapping lookup table may be formed in a same memory.

In an example embodiment, the data remapper may be configured to receive the flag and the grayscale value of the input image data from the still image determiner, configured to multiply a converting gain to the grayscale value of the input image data to generate a converted grayscale value, and configured to output the converted grayscale value to the driving frequency determiner.

In an example embodiment, the data remapper may be configured to extract a luminance component from the grayscale value of the input image data, configured to multiply a luminance compensating gain to the extracted luminance component of the input image data to generate a compensated luminance component, and configured to generate the converted grayscale value based on the compensated luminance component.

In an example embodiment, the driving controller may further include a fixed frequency determiner configured to determine whether an input frequency of the input image data has a normal type by counting a number of pulses of a horizontal synchronizing signal between a first pulse and a second pulse of a vertical synchronizing signal or by counting a number of pulses of a data enable signal between the first pulse and the second pulse of the vertical synchronizing signal.

In an example embodiment, the fixed frequency determiner may be configured to generate a frequency flag representing whether the input frequency of the input image data has the normal type or not. The driving frequency determiner may be configured to determine the driving frequency of the display panel.

In an exemplary embodiment, the maximum frequency grayscale area may be defined as an area equal to or greater than a first grayscale value and equal to or less than a second grayscale value. A converted maximum frequency grayscale area which is converted by the driving controller may be defined as an area equal to or greater than a third grayscale value and equal to or less than a fourth grayscale value. The third grayscale value may be greater than the first grayscale value. The fourth grayscale value may be less than the second grayscale value.

In an example embodiment, a converting gain to generate the converted maximum frequency grayscale area may be less than 1 in a first converting area and greater than 1 in a second converting area.

In an example embodiment, the maximum frequency grayscale area may be defined as an area equal to or greater than a first grayscale value. A converted maximum frequency grayscale area which is converted by the driving controller may be defined as an area equal to or greater than a second grayscale value. The second grayscale value may be greater than the first grayscale value.

In an example embodiment, a converting gain to generate the converted maximum frequency grayscale area may be equal to or less than 1.

In an exemplary embodiment, the display panel may include a plurality of segments in a matrix form. The driving controller may be configured to determine the driving frequency of the display panel based on optimal driving frequencies for the segments.

In an example embodiment of a method of driving a display panel, the method includes selectively determining a driving mode of a display apparatus between a normal driving mode and a low frequency driving mode, converting a grayscale value of input image data to decrease a size of a maximum frequency gray scale area corresponding to a maximum driving frequency in the low frequency driving mode, determining a driving frequency of the display panel using a flicker value storage configured to store a flicker value for the grayscale value of the input image data, outputting a gate signal to the display panel based on the driving frequency and outputting a data voltage to the display panel based on the driving frequency.

In an example embodiment, the determining the driving frequency may include selectively determining whether the input image data is a still image or a video image, generating a flag representing whether the input image data is the still image or the video image, selectively determining the driving mode of the display apparatus between the normal driving mode and the low frequency driving mode based on the flag and determining the driving frequency of the display panel using the flicker value storage.

In an example embodiment, the grayscale value of the input image data may be converted when the input image data is the still image. The grayscale value of the input image data may not be converted when the input image data is the video image.

In an example embodiment, the converting the grayscale value of input image data may include generating a converted grayscale value by multiplying a converting gain to the grayscale value of the input image data.

In an example embodiment, the converting the grayscale value of input image data may include extracting a luminance component from the grayscale value of the input image data, multiplying a luminance compensating gain to the extracted luminance component of the input image data to generate a compensated luminance component and generating the converted grayscale value based on the compensated luminance component.

In an example embodiment, the method may further include determining whether an input frequency of the input image data has a normal type by counting a number of pulses of a horizontal synchronizing signal between a first pulse and a second pulse of a vertical synchronizing signal or by counting a number of pulses of a data enable signal between the first pulse and the second pulse of the vertical synchronizing signal.

According to the method of driving the display panel and the display apparatus for performing the display panel, the driving frequency is determined according to an image displayed on the display panel so that power consumption of the display apparatus may be reduced. In addition, the driving frequency is determined using the flicker value of the image on the display panel so that a flicker of the image may be prevented and a display quality of the display panel may be enhanced. In addition, a high frequency driving grayscale area which is driven in a high driving frequency to prevent the flicker may be decreased by a data remapping method so that power consumption of the display apparatus may be further reduced.

BRIEF DESCRIPTION OF THE DRAWINGS

The above and other features and advantages of the present disclosure will become more apparent by describing in detailed example embodiments thereof with reference to the accompanying drawings, in which:

FIG. 4 is a table illustrating an example flicker value storage of FIG. 2;

FIG. 11 is a table illustrating the operation of the data remapper of FIG. 2;

DETAILED DESCRIPTION

Hereinafter, the present disclosure will be explained in detail with reference to the accompanying drawings.

Figure 1:
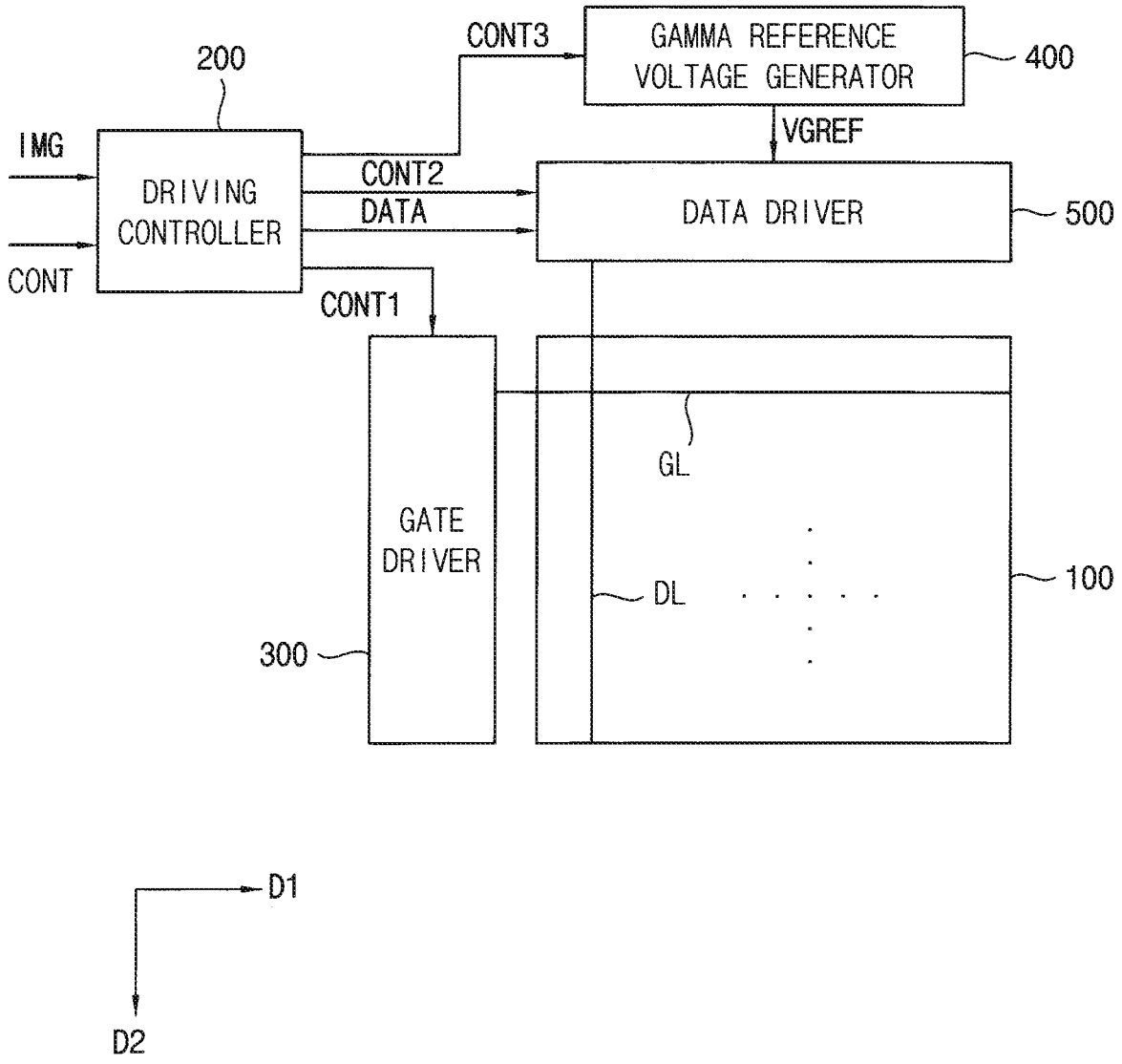
FIG. 1 is a block diagram illustrating a display apparatus according to an example embodiment of the present disclosure.

FIG. 1 is a block diagram illustrating a display apparatus according to an example embodiment of the present disclosure.

Referring to FIG. 1, the display apparatus includes a display panel 100 and a display panel driver. The display panel driver includes a driving controller 200, a gate driver 300, a gamma reference voltage generator 400, and a data driver 500.

In one example, the driving controller 200 and the data driver 500 may be integrally formed. In another example, the driving controller 200, the gamma reference voltage generator 400, and the data driver 500 may be integrally formed. A driving module including at least the driving controller 200 and the data driver 500 which are integrally formed may be called as a timing controller embedded data driver (TED).

The display panel 100 includes a plurality of gate lines GL, a plurality of data lines DL, and a plurality of pixels connected to both the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus (not shown). The input image data IMG may include red image data, green image data, and blue image data. The input image data IMG may further include white image data. The input image data IMG may further include magenta image data, yellow image data, and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

For example, the driving controller 200 may adjust a driving frequency of the display panel 100 based on the input image data IMG.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. For example, the gate driver 300 may be mounted on the display panel 100. For example, the gate driver 300 may be integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be integrally formed with the driving controller 200, or integrally formed with the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
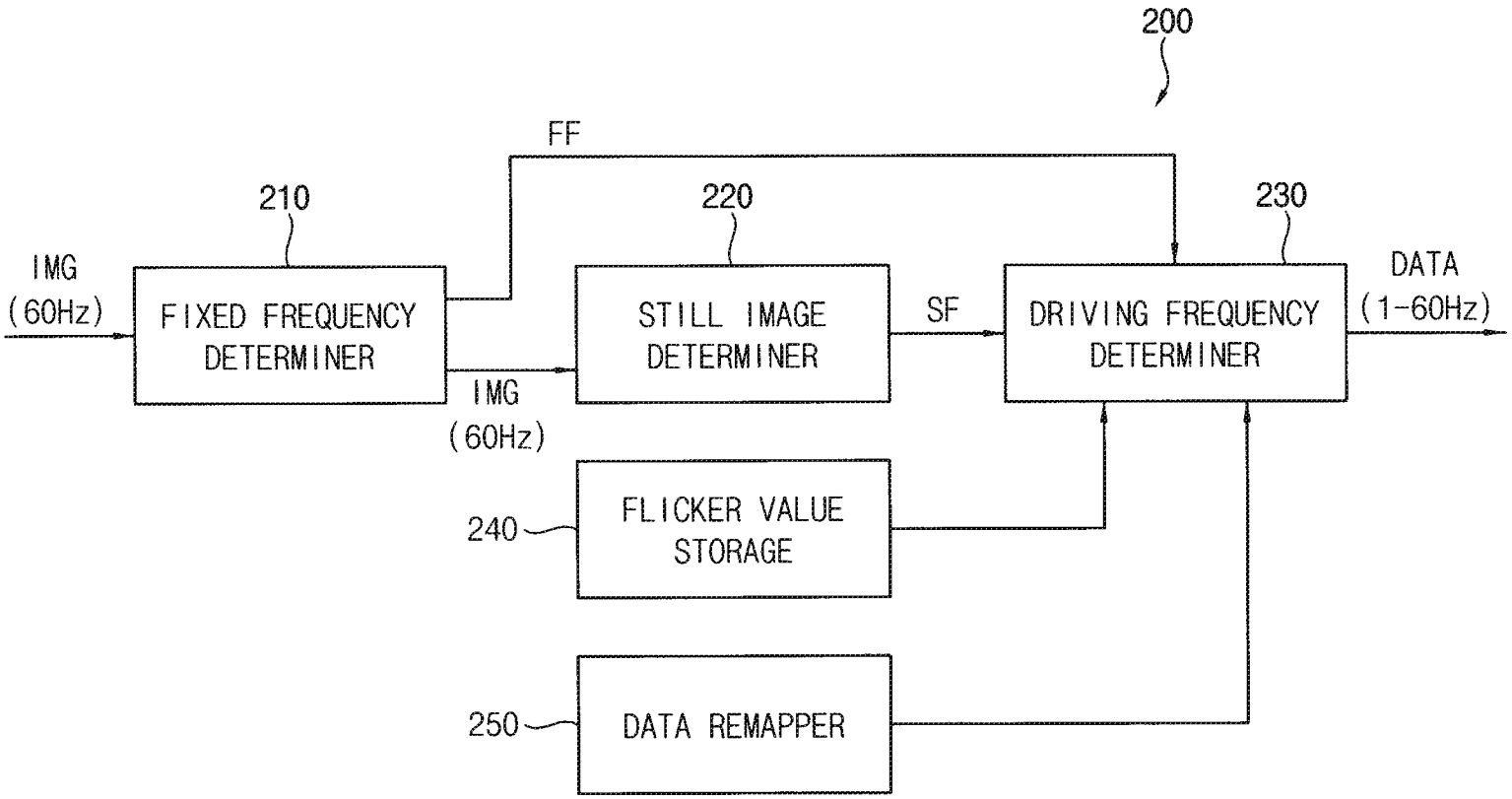
FIG. 2 is a block diagram illustrating a driving controller of FIG. 1.
Figure 3:
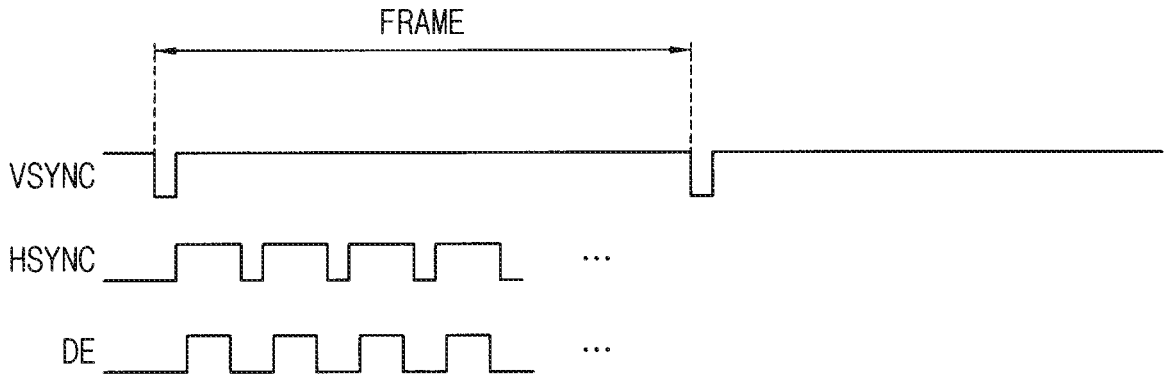
FIG. 3 is a timing diagram illustrating an operation of a fixed frequency determiner of FIG. 2.

A structure and an operation of the driving controller 200 are explained referring to FIGS. 2 to 4 in detail.

FIG. 2 is a block diagram illustrating the driving controller 200 of FIG. 1. FIG. 3 is a timing diagram illustrating an operation of a fixed frequency determiner 210 of FIG. 2. FIG. 4 is a table illustrating an example flicker value storage 240 of FIG. 2.

As depicted in FIG. 2, the driving controller 200 may include a still image determiner 220, a driving frequency determiner 230, a flicker value storage 240, and a data remapper 250. The driving controller 200 may further include a fixed frequency determiner 210.

The fixed frequency determiner 210 may determine whether an input frequency of the input image data IMG has a normal type. For example, the fixed frequency determiner 210 may determine whether the input frequency of the input image data IMG has the normal type by counting the number of pulses of a horizontal synchronizing signal HSYNC between a first pulse and a second pulse of a vertical synchronizing signal VSYNC or by counting the number of pulses of a data enable signal DE between the first pulse and the second pulse of the vertical synchronizing signal VSYNC.

As depicted in FIG. 3, time duration between the first pulse and the second pulse of the vertical synchronizing signal VSYNC may be defined to one frame. When the input frequency of the input image data IMG is 60 Hz, the number of the pulses of the horizontal synchronizing signal HSYNC between the first pulse and the second pulse of the vertical synchronizing signal VSYNC may be 60. In addition, when the input frequency of the input image data IMG is 60 Hz, the number of the pulses of the data enable signal DE between the first pulse and the second pulse of the vertical synchronizing signal VSYNC may be 60. When the number of the pulses of the horizontal synchronizing signal HSYNC or the number of the pulses of the data enable signal DE between the first pulse and the second pulse of the vertical synchronizing signal VSYNC is equal to the input frequency, the fixed frequency determiner 210 may determine that the input frequency of the input image data IMG has the normal type. In contrast, when the number of the pulses of the horizontal synchronizing signal HSYNC or the number of the pulses of the data enable signal DE between the first pulse and the second pulse of the vertical synchronizing signal VSYNC is not equal to the input frequency, the fixed frequency determiner 210 may determine that the input frequency of the input image data IMG dose not have the normal type.

The fixed frequency determiner 210 may generate a frequency flag FF representing whether the input frequency of the input image data IMG has the normal type or not. The fixed frequency determiner 210 may output the frequency flag FF to the driving frequency determiner 230. The driving frequency determiner 230 may determine the driving frequency of the display panel 100 based on the frequency flag FF. For example, when the input frequency of the input image data IMG does not have the normal type, the driving frequency determiner 230 may drive the switching elements in the pixel not in the low driving frequency but in the normal driving frequency. In this case, it is possible that the display may generate display defects due to the low driving frequency. In addition, the still image determiner 220 may not operate when the input frequency of the input image data IMG does not have the normal type, because the driving frequency is fixed to the normal driving frequency when the input frequency of the input image data IMG does not have the normal type.

The still image determiner 220 may determine whether the input image data IMG is a still image or a video image. The still image determiner 220 may output a flag SF representing whether the input image data IMG is the still image or the video image to the driving frequency determiner 230. For example, when the input image data IMG is the still image, the still image determiner 220 may output the flag SF of 1 to the driving frequency determiner 230. When the input image data IMG is the video image, the still image determiner 220 may output the flag SF of 0 to the driving frequency determiner 230. When the display panel 100 is operated in always on mode, the still image determiner 220 may output the flag SF of 1 to the driving frequency determiner 230.

When the flag SF is 1, the driving frequency determiner 230 may drive the switching elements in the pixel in a low driving frequency.

When the flag SF is 0, the driving frequency determiner 230 may drive the switching elements in the pixel in a normal driving frequency.

The driving frequency determiner 230 may refer the flicker value storage 240 to determine the low driving frequency. The flicker value storage 240 may include a flicker value representing a degree of a flicker according to a grayscale value of the input image data IMG.

The flicker value storage 240 may store the grayscale value of the input image data IMG and the flicker value corresponding to the grayscale value of the input image data IMG. The flicker value may be used for determining the driving frequency of the display panel 100. For example, the flicker value storage 240 may have a type of a lookup table.

In FIG. 4, the input grayscale value of the input image data IMG may be 8 bits, the minimum grayscale value of the input image data IMG may be 0 and the maximum grayscale value of the input image data IMG may be 255. The number of flicker setting stages of the flicker value storage 240 may be 64. When the number of the flicker setting stages increases, the flicker may be effectively removed but a logic size of the driving controller 200 may increase. Thus, the number of the flicker setting stages may be limited.

Although the input grayscale value of the input image data IMG is 8 bits in FIG. 4, the present inventive concept may not be limited.

In FIG. 4, the number of the grayscale values of the input image data IMG is 256 and the number of the flicker setting stages is 64 so that a single flicker value in the flicker value storage 240 may correspond to four grayscale values. For example, a first flicker setting stage stores the flicker value of 0 for the grayscale values of 0 to 3. Herein, the flicker value of 0 may represent the driving frequency of 1 Hz. For example, a second flicker setting stage stores the flicker value of 0 for the grayscale values of 4 to 7. Herein, the flicker value of 0 may represent the driving frequency of 1 Hz. For example, a third flicker setting stage stores the flicker value of 40 for the grayscale values of 8 to 11. Herein, the flicker value of 40 may represent the driving frequency of 2 Hz. For example, a fourth flicker setting stage stores the flicker value of 80 for the grayscale values of 12 to 15. Herein, the flicker value of 80 may represent the driving frequency of 5 Hz. For example, a fifth flicker setting stage stores the flicker value of 120 for the grayscale values of 16 to 19. Herein, the flicker value of 120 may represent the driving frequency of 10 Hz. For example, a sixth flicker setting stage stores the flicker value of 160 for the grayscale values of 20 to 23. Herein, the flicker value of 160 may represent the driving frequency of 30 Hz. For example, a seventh flicker setting stage stores the flicker value of 200 for the grayscale values of 24 to 27. Herein, the flicker value of 200 may represent the driving frequency of 60 Hz. For example, a sixty second flicker setting stage stores the flicker value of 0 for the grayscale values of 244 to 247. Herein, the flicker value of 0 may represent the driving frequency of 1 Hz. For example, a sixty third flicker setting stage stores the flicker value of 0 for the grayscale values of 248 to 251. Herein, the flicker value of 0 may represent the driving frequency of 1 Hz. For example, a sixty fourth flicker setting stage stores the flicker value of 0 for the grayscale values of 252 to 255. Herein, the flicker value of 0 may represent the driving frequency of 1 Hz.

Referring back to FIG. 2, the data remapper 250 may convert the grayscale value of the input image data IMG to reduce a size of a maximum driving grayscale area corresponding to a maximum driving frequency in the low frequency driving mode. If the size of the maximum driving grayscale area corresponding to the maximum driving frequency in the low frequency driving mode is reduced, possibility to be driven in the maximum driving frequency in the low frequency driving mode may decrease so that power consumption of the display apparatus may be reduced.

For example, when the input image data IMG is the still image, the data remapper 250 may convert the grayscale value of the input image data IMG. In contrast, when the input image data IMG is the video image, the data remapper 250 may not convert the grayscale value of the input image data IMG.

For example, the driving frequency determiner 230 may apply a converted grayscale value which is converted by the data remapper 230 to the flicker value storage 240 to determine the driving frequency of the display panel 100.

In the present example embodiment, the data remapper 250 may include a data remapping lookup table for generating the converted grayscale value by multiplying a converting gain to the grayscale value of the input image data IMG.

For example, the flicker value storage 240 and the data remapping lookup table may be formed in the same memory. Alternatively, the flicker value storage 240 and the data remapping lookup table may be respectively formed in different memories.

An operation of the data remapper 250 is explained referring to FIGS. 8 to 12 and 15 to 18 in detail.

Figure 5:
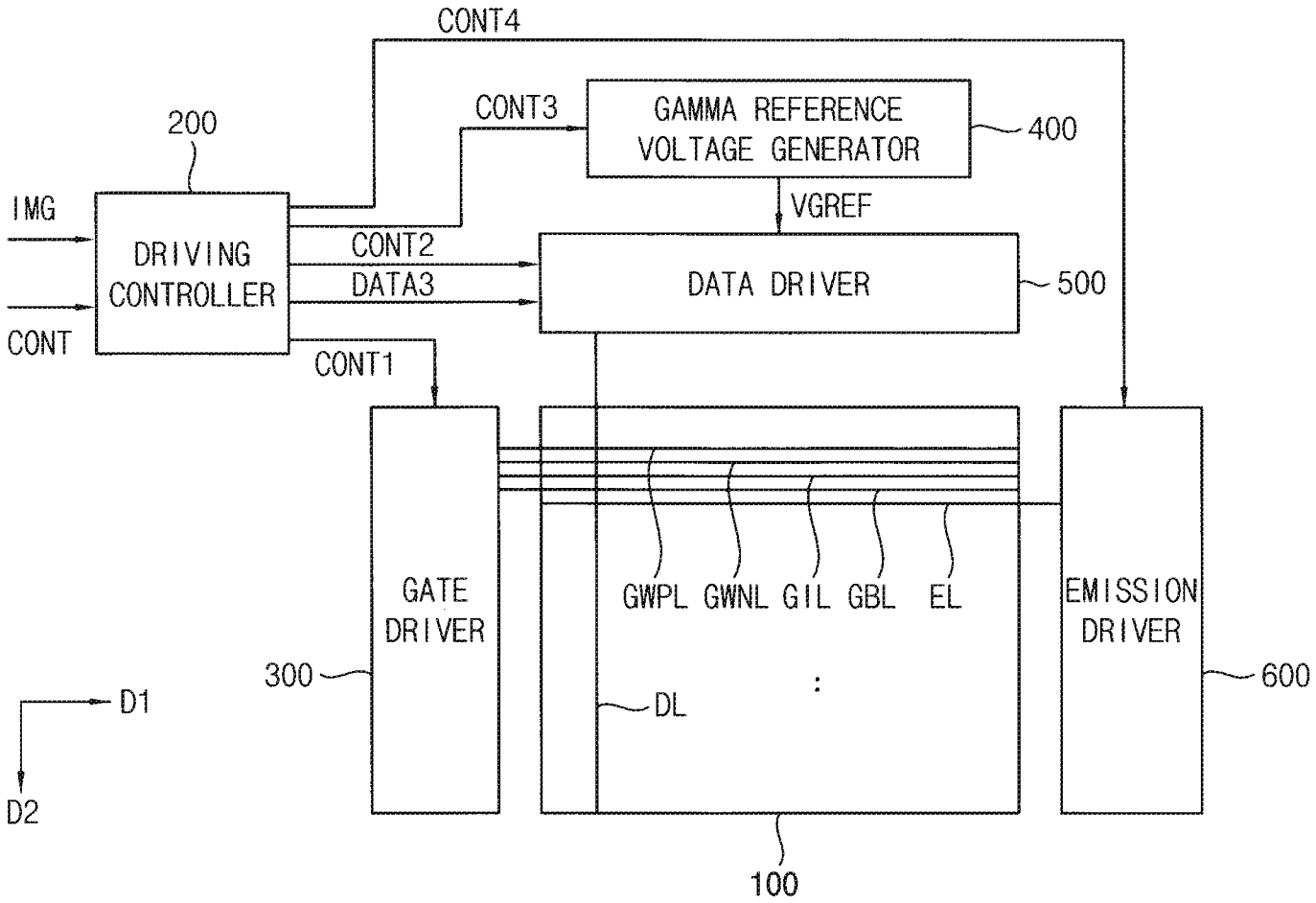
FIG. 5 is a block diagram illustrating an example of the display apparatus of FIG. 1.
Figure 6:
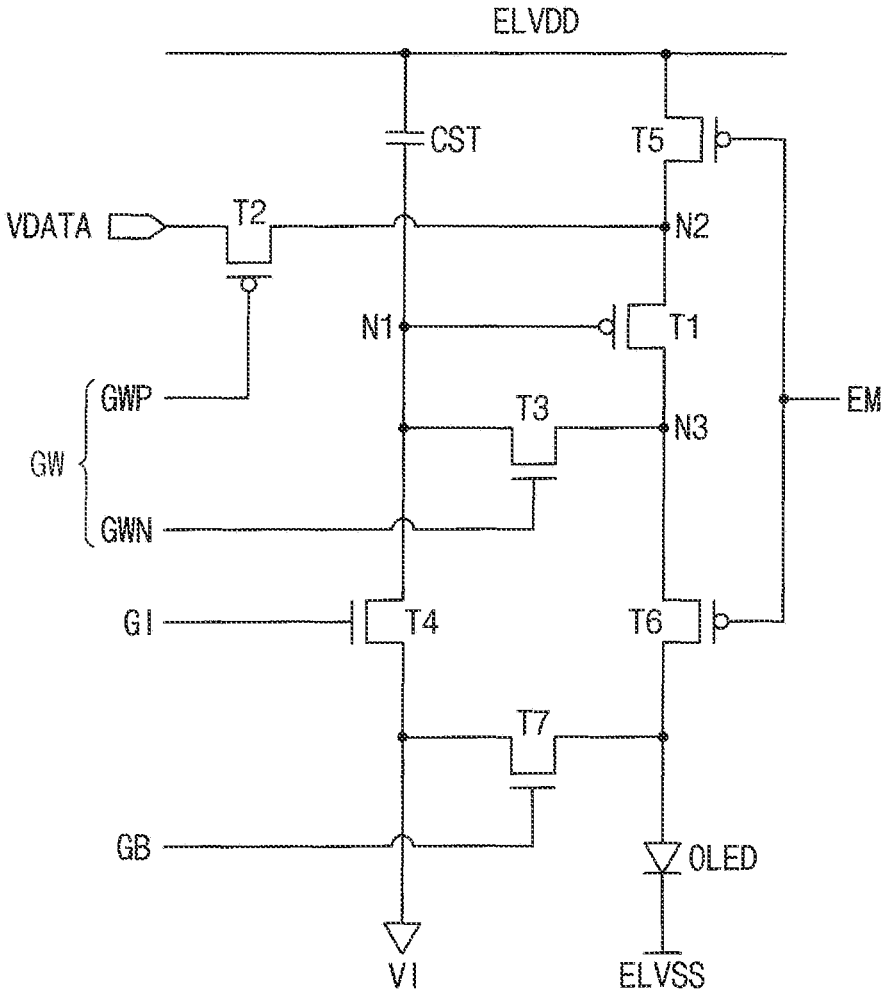
FIG. 6 is a circuit diagram illustrating a pixel of a display panel of FIG. 5.
Figure 7:
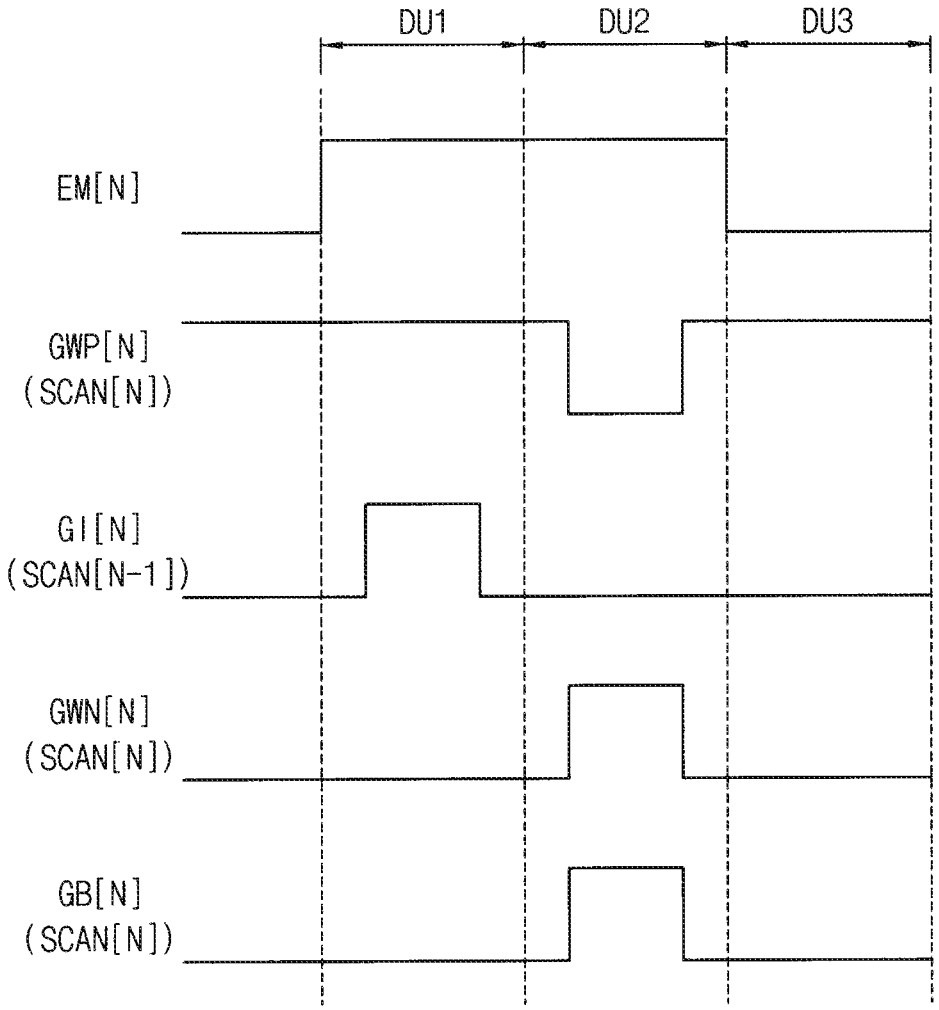
FIG. 7 is a timing diagram illustrating input signals applied to the pixel of FIG. 6.

FIG. 5 is a block diagram illustrating an example of the display apparatus of FIG. 1. FIG. 6 is a circuit diagram illustrating a pixel of a display panel 100 of FIG. 5. FIG. 7 is a timing diagram illustrating input signals applied to the pixel of FIG. 6.

Referring to FIG. 5, the display panel driver may further include an emission driver 600.

The display panel 100 includes a plurality of gate lines GWPL, GWNL, GIL, and GBL, a plurality of data lines DL, a plurality of emission lines EL, and a plurality of pixels electrically connected to the gate lines GWPL, GWNL, GIL, and GBL, the data lines DL, and the emission lines EL. The gate lines GWPL, GWNL, GIL, and GBL may extend in a first direction D1, the data lines DL may extend in a second direction D2 crossing the first direction D1, and the emission lines EL may extend in the first direction D1.

The driving controller 200 may further generate a fourth control signal CONT4 based on the input control signal CONT.

The emission driver 600 generates emission signals to drive the emission lines EL in response to the fourth control signal CONT4 received from the driving controller 200. The emission driver 600 may output the emission signals to the emission lines EL.

The display panel 100 includes the plurality of the pixels. Each pixel includes an organic light emitting element OLED.

After each pixel receives a data write gate signal GW, a data initialization gate signal GI, an organic light emitting element initialization signal GB, the data voltage VDATA, and the emission signal EM, the organic light emitting element OLED of the pixel emits light corresponding to the level of the data voltage VDATA to display the image.

In the present example embodiment, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

For example, the data write gate signal GW may include a first data write gate signal GWP and a second data write gate signal GWN. The first data write gate signal GWP may be applied to the P-type transistor so that the first data write gate signal GWP has an activation signal of a low level corresponding to a data writing timing. The second data write gate signal GWN may be applied to the N-type transistor so that the second data write gate signal GWN has an activation signal of a high level corresponding to the data writing timing.

As depicted in FIG. 6, at least one of the pixels may include first to seventh pixel switching elements T1 to T7, a storage capacitor CST, and the organic light emitting element OLED.

The first pixel switching element T1 includes a control electrode connected to a first node N1, an input electrode connected to a second node N2, and an output electrode connected to a third node N3.

For example, the first pixel switching element T1 may be the polysilicon thin film transistor. For example, the first pixel switching element T1 may be the P-type thin film transistor. The control electrode of the first pixel switching element T1 may be a gate electrode, the input electrode of the first pixel switching element T1 may be a source electrode, and the output electrode of the first pixel switching element T1 may be a drain electrode.

The second pixel switching element T2 includes a control electrode to which the first data write gate signal GWP is applied, an input electrode to which the data voltage VDATA is applied, and an output electrode connected to the second node N2.

For example, the second pixel switching element T2 may be the polysilicon thin film transistor. For example, the second pixel switching element T2 may be the P-type thin film transistor. The control electrode of the second pixel switching element T2 may be a gate electrode, the input electrode of the second pixel switching element T2 may be a source electrode, and the output electrode of the second pixel switching element T2 may be a drain electrode.

The third pixel switching element T3 includes a control electrode to which the second data write gate signal GWN is applied, an input electrode connected to the first node N1, and an output electrode connected to the third node N3.

For example, the third pixel switching element T3 may be the oxide thin film transistor. For example, the third pixel switching element T3 may be the N-type thin film transistor. The control electrode of the third pixel switching element T3 may be a gate electrode, the input electrode of the third pixel switching element T3 may be a source electrode and the output electrode of the third pixel switching element T3 may be a drain electrode.

The fourth pixel switching element T4 includes a control electrode to which the data initialization gate signal GI is applied, an input electrode to which an initialization voltage VI is applied, and an output electrode connected to the first node N1.

For example, the fourth pixel switching element T4 may be the oxide thin film transistor. For example, the fourth pixel switching element T4 may be the N-type thin film transistor. The control electrode of the fourth pixel switching element T4 may be a gate electrode, the input electrode of the fourth pixel switching element T4 may be a source electrode, and the output electrode of the fourth pixel switching element T4 may be a drain electrode.

The fifth pixel switching element T5 includes a control electrode to which the emission signal EM is applied, an input electrode to which a high power voltage ELVDD is applied and an output electrode connected to the second node N2.

For example, the fifth pixel switching element T5 may be the polysilicon thin film transistor. For example, the fifth pixel switching element T5 may be the P-type thin film transistor. The control electrode of the fifth pixel switching element T5 may be a gate electrode, the input electrode of the fifth pixel switching element T5 may be a source electrode, and the output electrode of the fifth pixel switching element T5 may be a drain electrode.

The sixth pixel switching element T6 includes a control electrode to which the emission signal EM is applied, an input electrode connected to the third node N3, and an output electrode connected to an anode electrode of the organic light emitting element OLED.

For example, the sixth pixel switching element T6 may be the polysilicon thin film transistor. For example, the sixth pixel switching element T6 may be a P-type thin film transistor. The control electrode of the sixth pixel switching element T6 may be a gate electrode, the input electrode of the sixth pixel switching element T6 may be a source electrode, and the output electrode of the sixth pixel switching element T6 may be a drain electrode.

The seventh pixel switching element T7 includes a control electrode to which the organic light emitting element initialization gate signal GB is applied, an input electrode to which the initialization voltage VI is applied, and an output electrode connected to the anode electrode of the organic light emitting element OLED.

For example, the seventh pixel switching element T7 may be the oxide thin film transistor. For example, the seventh pixel switching element T7 may be the N-type thin film transistor. The control electrode of the seventh pixel switching element T7 may be a gate electrode, the input electrode of the seventh pixel switching element T7 may be a source electrode, and the output electrode of the seventh pixel switching element T7 may be a drain electrode.

The storage capacitor CST includes a first electrode to which the high power voltage ELVDD is applied and a second electrode connected to the first node N1.

The organic light emitting element OLED includes the anode electrode and a cathode electrode to which a low power voltage ELVSS is applied.

In FIG. 7, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. In addition, during the second duration DU2, the anode electrode of the organic light emitting element OLED is initialized in response to the organic light emitting element initialization gate signal GB. During a third duration DU3, the organic light emitting element OLED emit the light in response to the emission signal EM so that the display panel 100 displays the image.

Although the organic light emitting element initialization gate signal GB has a timing equal to a timing of the first and second data write gate signals GWP and GWN in the present example embodiment, the present disclosure may not be limited. The organic light emitting element initialization gate signal GB may have a timing different from the timing of the first and second data write gate signals GWP and GWN.

In the present example embodiment, some of the pixel switching elements may be designed using the oxide thin film transistors. In the present example embodiment, the third pixel switching element T3, the fourth pixel switching element T4 and the seventh pixel switching element T7 may be the oxide thin film transistors. The first pixel switching element T1, the second pixel switching element T2, the fifth pixel switching element T5, and the sixth pixel switching element T6 may be the polysilicon thin film transistors.

The display panel 100 may be driven in a normal driving mode in which the display panel 100 is driven in a normal driving frequency and in a low frequency driving mode in which the display panel 100 is driven in a frequency less than the normal driving frequency.

For example, when the input image data represent a video image, the display panel 100 may be driven in the normal driving mode. For example, when the input image data represent a still image, the display panel may be driven in the low frequency driving mode. For example, when the display apparatus is operated in the always on mode, the display panel may be driven in the low frequency driving mode.

The display panel 100 may be driven in a unit of frame. The display panel 100 may be refreshed in every frame in the normal driving mode. Thus, the normal driving mode includes only writing frames in which the data is written in the pixel.

The display panel 100 may be refreshed in the frequency of the low frequency driving mode in the low frequency driving mode. Thus, the low frequency driving mode includes the writing frames in which the data is written in the pixel and holding frames in which the written data is maintained without writing the data in the pixel.

For example, when the frequency of the normal driving mode is 60 Hz and the frequency of the low frequency driving mode is 1 Hz, the low frequency driving mode includes one writing frame and fifty nine holding frames in a second. For example, when the frequency of the normal driving mode is 60 Hz and the frequency of the low frequency driving mode is 1 Hz, fifty nine continuous holding frames are disposed between two adjacent writing frames.

For example, when the frequency of the normal driving mode is 60 Hz and the frequency of the low frequency driving mode is 10 Hz, the low frequency driving mode includes ten writing frame and fifty holding frames in a second. For example, when the frequency of the normal driving mode is 60 Hz and the frequency of the low frequency driving mode is 10 Hz, five continuous holding frames are disposed between two adjacent writing frames.

The driving controller 200 in FIG. 2 may be applied to the structure of the display panel of the present example embodiment. When the flag SF is 1, the driving frequency determiner 230 may drive the switching elements of the first type in the normal driving frequency and the switching elements of the second type in the low driving frequency. When the flag SF is 0, the driving frequency determiner 230 may drive the switching elements of the first type and the switching element of the second type in the normal driving frequency.

For example, the second data writing gate signal GWN and the data initialization gate signal GI may have a first frequency in the low frequency driving mode. The first frequency may be the frequency of the low frequency driving mode. In contrast, the first data writing gate signal GWP, the emission signal EM, and the organic light emitting element initialization gate signal GB may have a second frequency greater than the first frequency. The second frequency may be the normal frequency of the normal driving mode.

Figure 8:
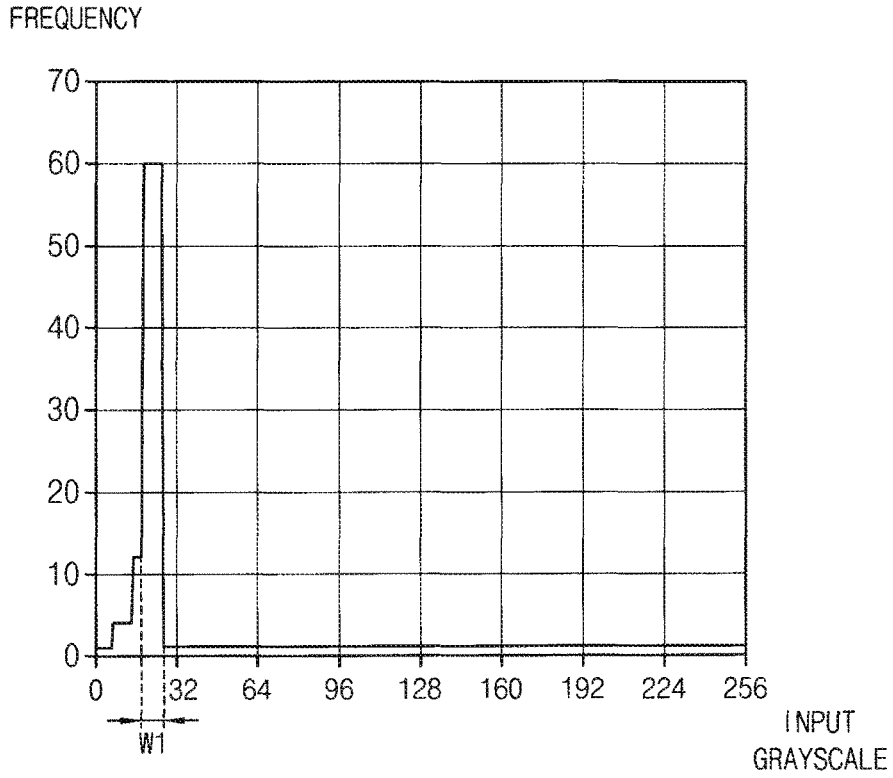
FIG. 8 is a graph illustrating a driving frequency according to input grayscale values prior to a data remapping operation of a data remapper of FIG. 2.
Figure 9:
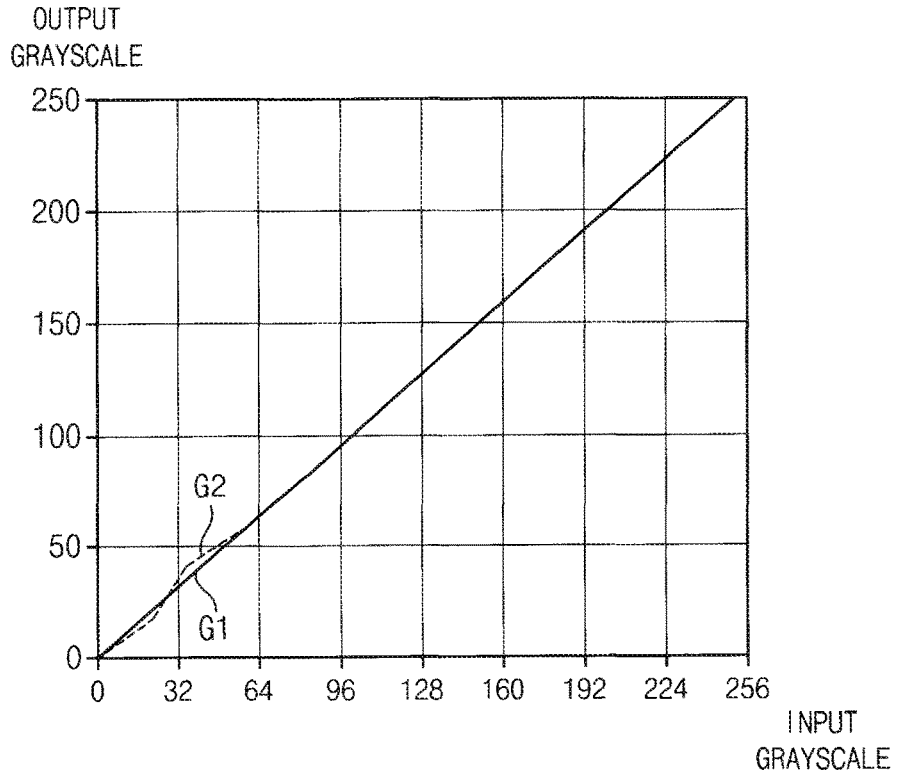
FIGS. 9 and 10 are graphs illustrating the operation of the data remapper of FIG. 2.
Figure 10:
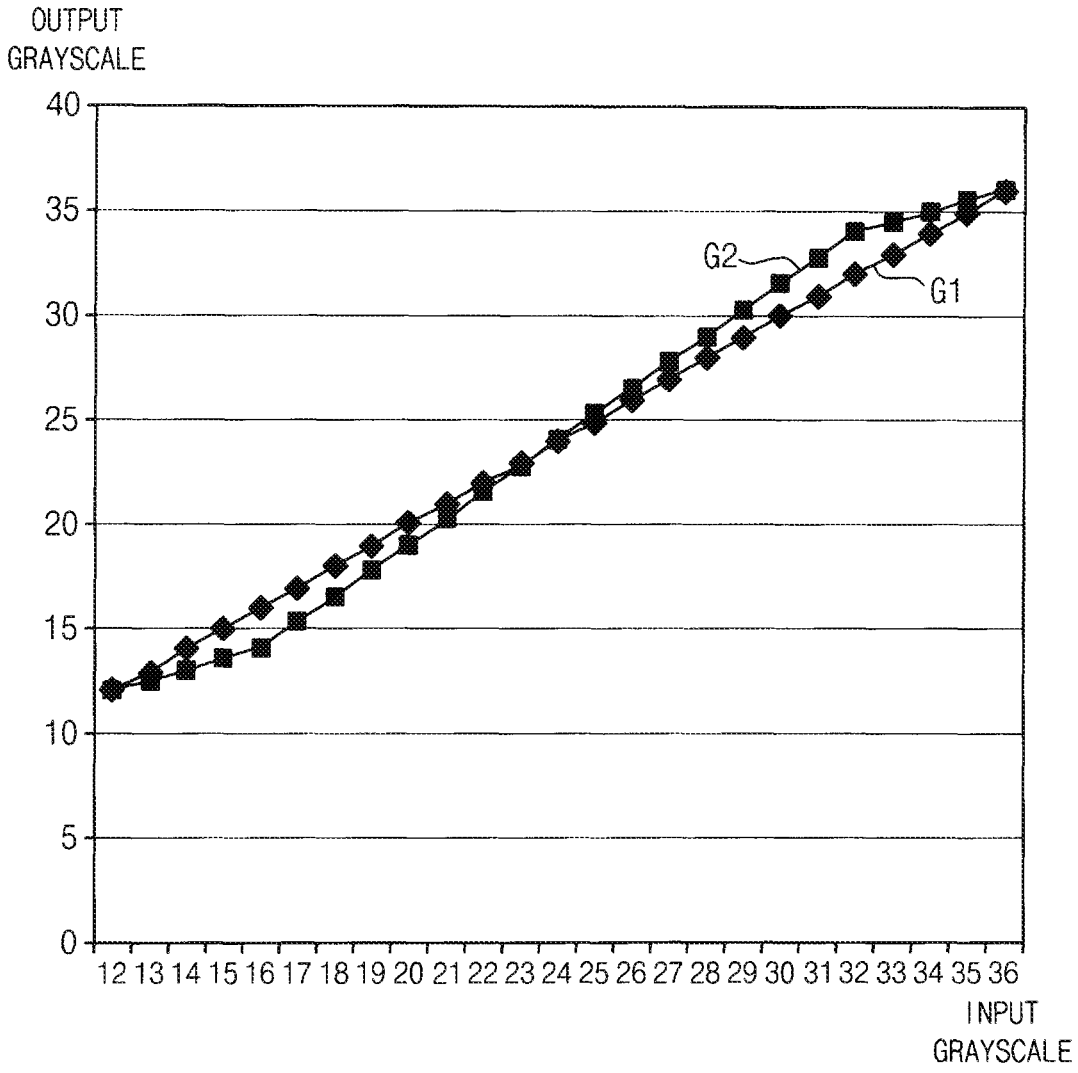
Figure 12:
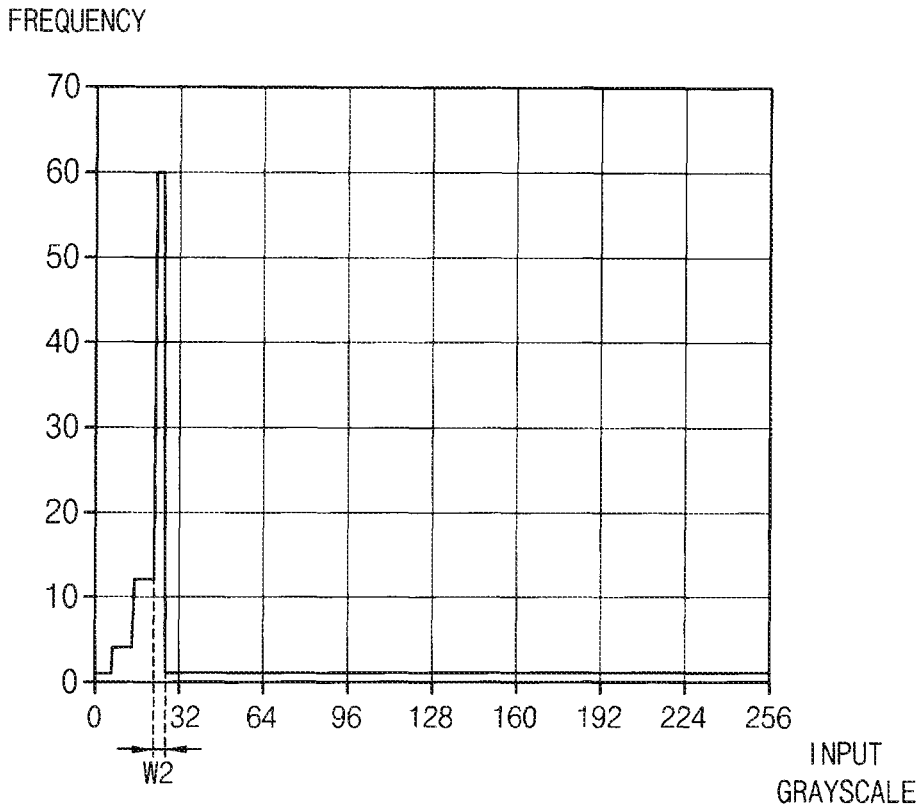
FIG. 12 is a graph illustrating a driving frequency according to input grayscale values after the data remapping operation of the data remapper of FIG. 2.

FIG. 8 is a graph illustrating a driving frequency according to input grayscale values prior to a data remapping operation of the data remapper 250 of FIG. 2. FIGS. 9 and 10 are graphs illustrating the operation of the data remapper 250 of FIG. 2. FIG. 11 is a table illustrating the operation of the data remapper 250 of FIG. 2. FIG. 12 is a graph illustrating a driving frequency according to input grayscale values after the data remapping operation of the data remapper 250 of FIG. 2.

FIGS. 8 to 12 represent an example of the data remapping operation applied to the pixel structure of FIG. 6.

Referring to FIGS. 1 to 12, the flicker may be generated for the pixel structure of FIG. 6 in a relatively low grayscale area. For example, in FIG. 8, a maximum frequency grayscale area corresponding to a maximum driving frequency (e.g. 60 Hz) in the low frequency driving mode may be defined as an area equal to or greater than a first grayscale value and equal to or less than a second grayscale value. In FIG. 8, a size of the maximum frequency grayscale area may be represented to W1. For example, the first grayscale value may be 18 and the second grayscale value may be 30. A central grayscale value of the maximum frequency grayscale area may be 24.

The data remapper 250 may generate a converted grayscale value (an output grayscale value) by multiplying a converting gain G2 to the input image data IMG. When the converting gain G2 is 1, the input grayscale value may be equal to the converted grayscale value. When the converting gain G2 is greater than 1, the converted grayscale value may be greater than the input grayscale value. When the converting gain G2 is less than 1, the converted grayscale value may be less than the input grayscale value.

The converting gain G2 to generate a converted maximum frequency grayscale area may be less than 1 in a first converting area and greater than 1 in a second converting area. For example, the first converting area may be a grayscale area equal to or greater than 13 and equal to or less than 23 in FIGS. 10 and 11. For example, the second converting area may be a grayscale area equal to or greater than 25 and equal to or less than 35 in FIGS. 10 and 11.

The converting gain G2 may be 1 in a grayscale area except for the first converting area and the second converting area. In FIGS. 9 and 10, a first gain line G1 represents the converting gain of 1. The first gain line G1 is illustrated to be compared to a curve of the converting gain G2 of the present example embodiment.

The maximum frequency grayscale area W1 may be converted in to the converted maximum frequency grayscale area W2 by the driving controller 200.

In FIG. 12, the converted maximum frequency grayscale area W2 corresponding to the maximum driving frequency (e.g. 60 Hz) in the low frequency driving mode may be defined as an area equal to or greater than a third grayscale value and equal to or less than a fourth grayscale value. In FIG. 12, a size of the converted maximum frequency grayscale area may be represented to W2.

In FIG. 8, the grayscale values between 18 and 30 may be driven in the maximum driving frequency of 60 Hz. The input grayscale value of the input image data IMG may be converted into the converted grayscale value by the data remapper 250. In FIG. 11, the input grayscale value of 18 is converted into the converted grayscale value of 16.5. The converted grayscale value of 16.5 is located outside of the maximum frequency grayscale area range (between 18 and 30) in FIG. 8. In this way, when the data remapping operation is applied to the input grayscale value of 18 of the input image data IMG, the input grayscale value of 18 of the input image data IMG may be driven in a driving frequency less than the maximum driving frequency of 60 Hz. In FIG. 11, the input grayscale value of 19 is converted into the converted grayscale value of 17.75. The converted grayscale value of 17.75 is located outside of the maximum frequency grayscale area range (between 18 and 30) in FIG. 8. In this way, when the data remapping operation is applied to the input grayscale value of 19 of the input image data IMG, the input grayscale value of 19 of the input image data IMG may be driven in a driving frequency less than the maximum driving frequency of 60 Hz. In contrast, in FIG. 11, the input grayscale value of 20 is converted into the converted grayscale value of 19. The converted grayscale value of 19 is located inside of the maximum frequency grayscale area range (between 18 and 30) in FIG. 8. Thus, although the data remapping operation is applied to the input grayscale value of 20 of the input image data IMG, the input grayscale value of 20 of the input image data IMG may be driven in the maximum driving frequency of 60 Hz.

Similarly, in FIG. 11, the input grayscale value of 30 is converted into the converted grayscale value of 31.5. The converted grayscale value of 31.5 is located outside of the maximum frequency grayscale area range (between 18 and 30) in FIG. 8. In this way, when the data remapping operation is applied to the input grayscale value of 30 of the input image data IMG, the input grayscale value of 30 of the input image data IMG may be driven in a driving frequency less than the maximum driving frequency of 60 Hz. In FIG. 11, the input grayscale value of 29 is converted into the converted grayscale value of 30.25. The converted grayscale value of 30.25 is located outside of the maximum frequency grayscale area range (between 18 and 30) in FIG. 8. In this way, when the data remapping operation is applied to the input grayscale value of 29 of the input image data IMG, the input grayscale value of 29 of the input image data IMG may be driven in a driving frequency less than the maximum driving frequency of 60 Hz. In contrast, in FIG. 11, the input grayscale value of 28 is converted into the converted grayscale value of 29. The converted grayscale value of 29 is located inside of the maximum frequency grayscale area range (between 18 and 30) in FIG. 8. Thus, although the data remapping operation is applied to the input grayscale value of 28 of the input image data IMG, the input grayscale value of 28 of the input image data IMG may be driven in the maximum driving frequency of 60 Hz.

As explained above, the third grayscale value and the fourth grayscale value defining the converted maximum frequency grayscale area W2 may be respectively 20 and 28. As a result, the graph of the driving frequency according to the input grayscale values of the input image data IMG of FIG. 8 is converted into the graph of the driving frequency according to the input grayscale values of the input image data IMG of FIG. 12 by the data remapping operation of the data remapper 250. Thus, the maximum frequency grayscale area corresponding to the maximum driving frequency in the low frequency driving mode may be decreased by the data remapping operation of the data remapper 250.

According to the present example embodiment, the driving frequency is determined according to the image displayed on the display panel 100 so that power consumption of the display apparatus may be reduced. In addition, the driving frequency is determined using the flicker value of the image on the display panel 100 so that the flicker of the image may be prevented and the display quality of the display panel 100 may be enhanced. In addition, the high frequency driving grayscale area which is driven in the high driving frequency to prevent the flicker may be decreased by the data remapping method so that power consumption of the display apparatus may be further reduced.

Figure 13:
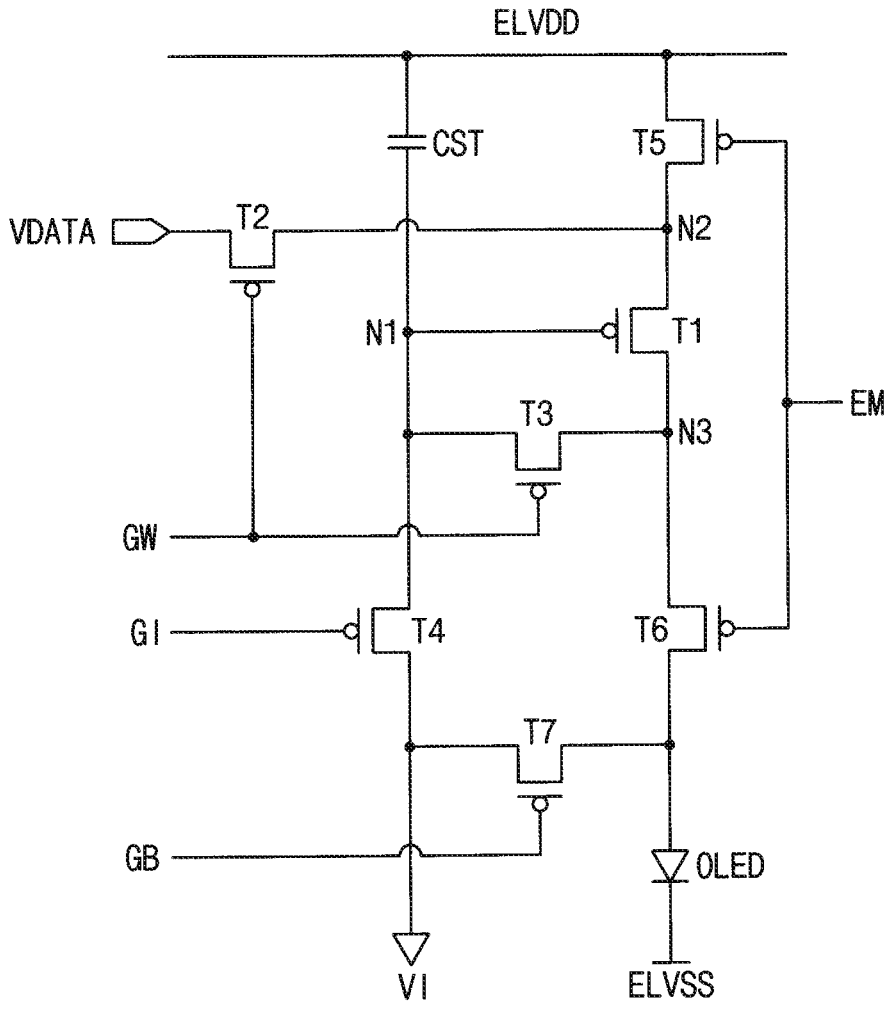
FIG. 13 is a circuit diagram illustrating a pixel of a display panel of a display apparatus according to an example embodiment of the present disclosure.
Figure 14:
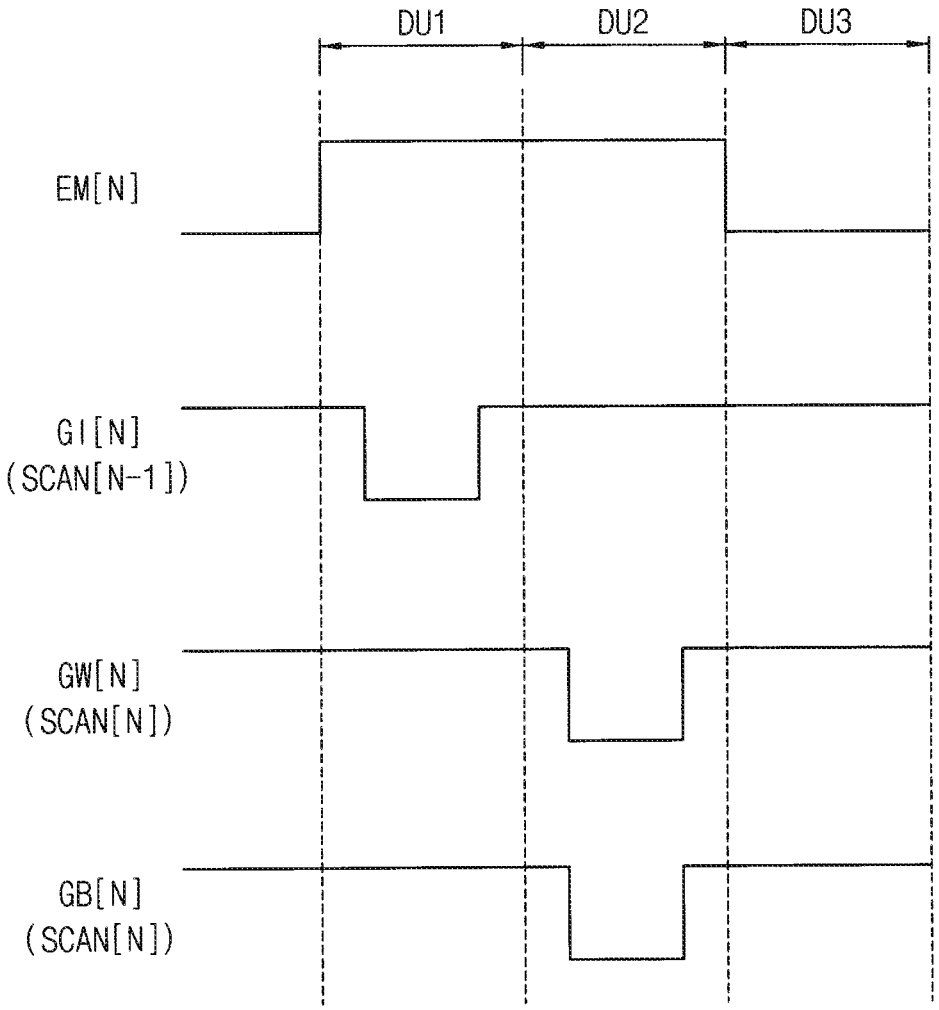
FIG. 14 is a timing diagram illustrating input signals applied to the pixel of FIG. 13.

FIG. 13 is a circuit diagram illustrating a pixel of a display panel 100 of a display apparatus according to an example embodiment of the present disclosure. FIG. 14 is a timing diagram illustrating input signals applied to the pixel of FIG. 13.

The display apparatus and the method of driving the display panel according to the present example embodiment is substantially equal to the display apparatus and the method of driving the display panel of the previous example embodiment explained referring to FIGS. 1 to 12 except for the pixel structure of the display panel and the profiles of the flicker according to the grayscale value for the pixel structure. Thus, the same reference numerals will be used to refer to the same or like parts as those described in the previous example embodiment of FIGS. 1 to 12 and any repetitive explanation concerning the above elements will be omitted.

Referring to FIGS. 1 to 5, 13, and 14, the display panel includes a plurality of pixels. Each pixel includes an organic light emitting element OLED.

After each pixel receives a data write gate signal GW, a data initialization gate signal GI, an organic light emitting element initialization signal GB, the data voltage VDATA, and the emission signal EM, the organic light emitting element OLED of the pixel emits light corresponding to the level of the data voltage VDATA to display the image.

As depicted in FIG. 14, although the organic light emitting element initialization gate signal GB has a timing equal to a timing of the data write gate signal GW in the present example embodiment, the present disclosure may not be limited. The organic light emitting element initialization gate signal GB may have a timing different from the timing of the data write gate signal GW.

In the present example embodiment, the pixel may include switching elements of a first type. For example, the switching element of the first type may be a polysilicon thin film transistor. For example, the switching element of the first type may be a low temperature polysilicon (LTPS) thin film transistor. For example, the switching element of the first type may be a P-type transistor.

At least one of the pixels may include first to seventh pixel switching elements T1 to T7, a storage capacitor CST and the organic light emitting element OLED. In the present example embodiment, the first to seventh pixel switching elements T1 to T7 may be P-type thin film transistors.

Figure 15:
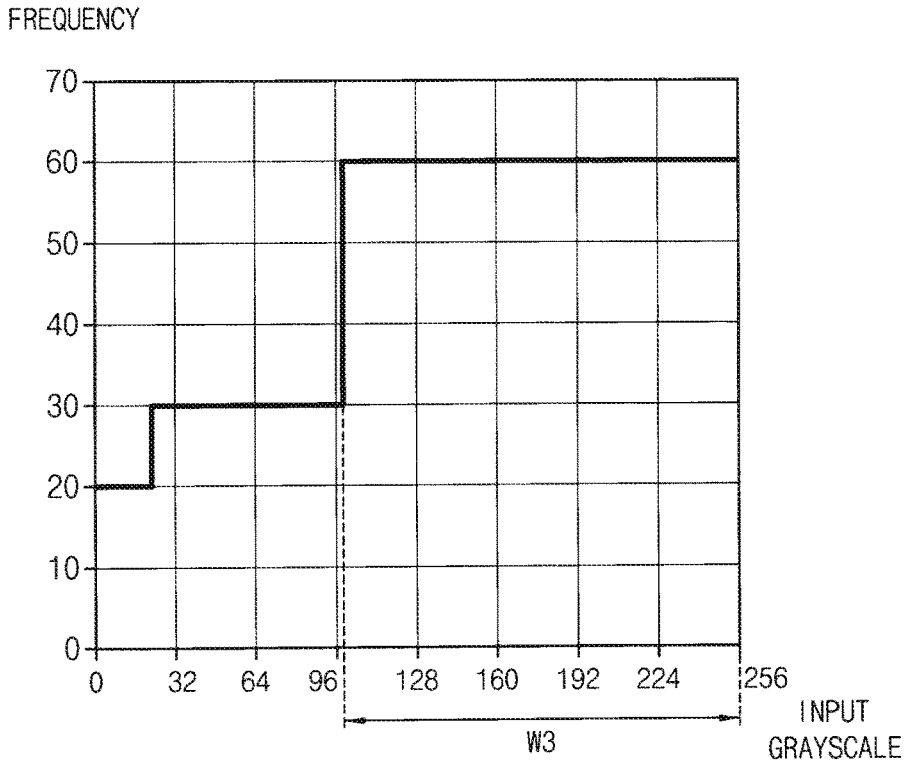
FIG. 15 is a graph illustrating a driving frequency according to input grayscale values prior to a data remapping operation of a data remapper of FIG. 2.
Figure 16:
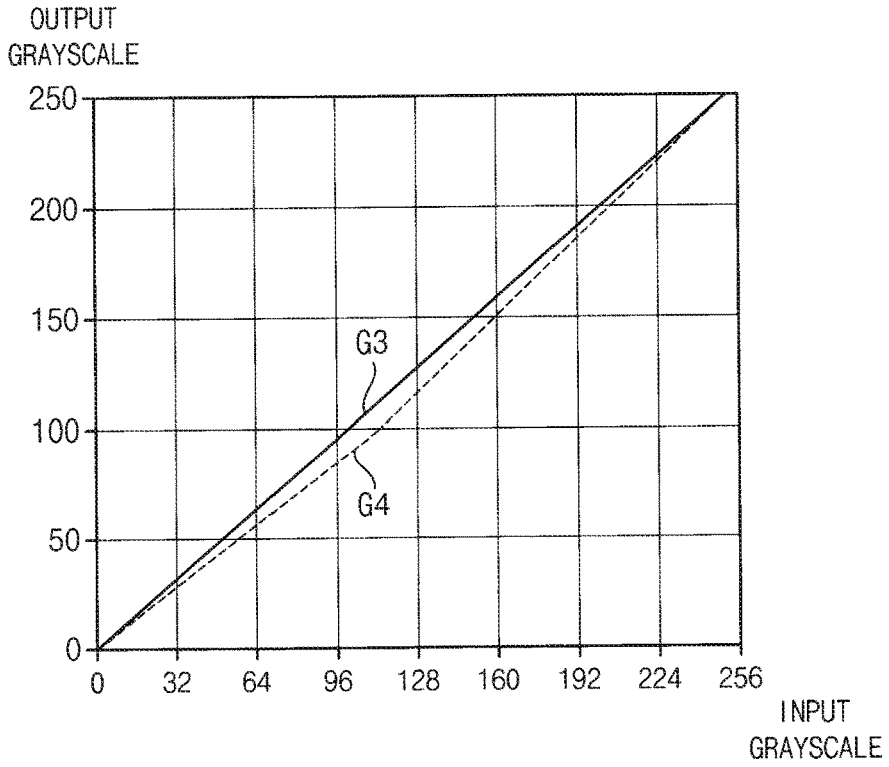
FIG. 16 is a graph illustrating the operation of the data remapper of FIG. 2.
Figures 17, 18:
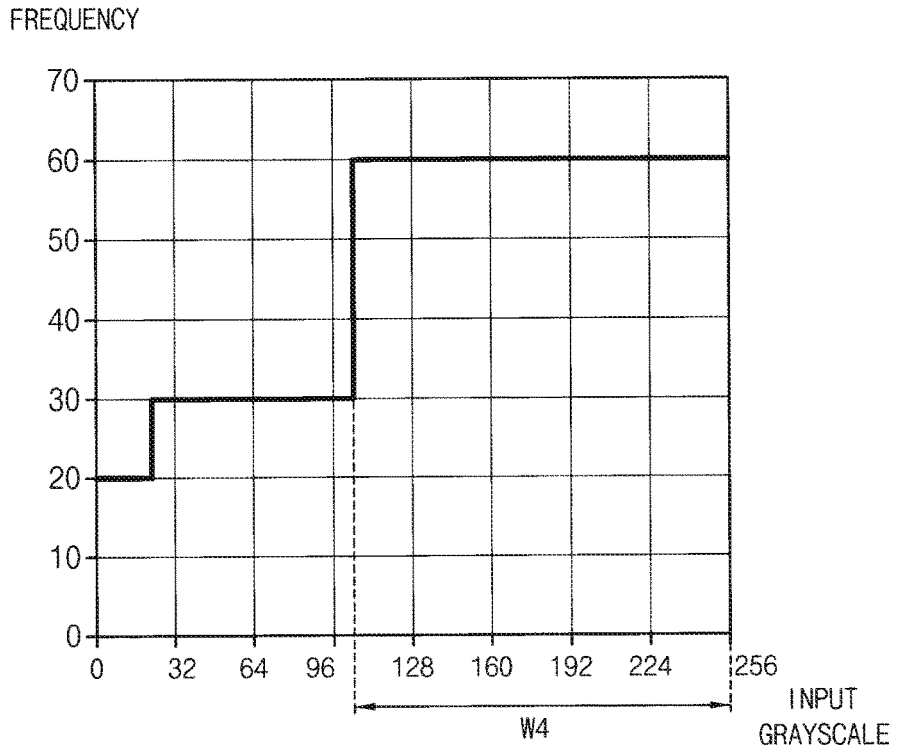
FIG. 17 is a table illustrating the operation of the data remapper of FIG. 2.
FIG. 18 is a graph illustrating a driving frequency according to input grayscale values after the data remapping operation of the data remapper of FIG. 2.

FIG. 15 is a graph illustrating a driving frequency according to input grayscale values prior to a data remapping operation of the data remapper 250 of FIG. 2. FIG. 16 is a graph illustrating the operation of the data remapper 250 of FIG. 2. FIG. 17 is a table illustrating the operation of the data remapper 250 of FIG. 2. FIG. 18 is a graph illustrating a driving frequency according to input grayscale values after the data remapping operation of the data remapper 250 of FIG. 2.

FIGS. 15 to 18 may represent the data remapping operation applied to the pixel structure of FIG. 13.

FIGS. 1 to 5 and 13 to 18, for example, the flicker may be generated for the pixel structure of FIG. 13 in a relatively high grayscale area. For example, in FIG. 15, a maximum frequency grayscale area corresponding to a maximum driving frequency (e.g. 60 Hz) in the low frequency driving mode may be defined as an area equal to or greater than a first grayscale value. In FIG. 15, a size of the maximum frequency grayscale area may be represented to W3. For example, the first grayscale value may be 97.

The data remapper 250 may generate a converted grayscale value (an output grayscale value) by multiplying a converting gain G4 to the input image data IMG. When the converting gain G4 is 1, the input grayscale value may be equal to the converted grayscale value. When the converting gain G4 is greater than 1, the converted grayscale value may be greater than the input grayscale value. When the converting gain G4 is less than 1, the converted grayscale value may be less than the input grayscale value.

The converting gain G4 to generate a converted maximum frequency grayscale area may be equal to or less than 1. For example, the converting gain G4 may be equal to or less than 1 in an entire grayscale area.

In FIG. 16, a third gain line G3 represents the converting gain of 1. The third gain line G3 is illustrated to be compared to a curve of the converting gain G4 of the present example embodiment.

The maximum frequency grayscale area W3 may be converted in to the converted maximum frequency grayscale area W4 by the driving controller 200.

In FIG. 18, the converted maximum frequency grayscale area W4 corresponding to the maximum driving frequency (e.g. 60 Hz) in the low frequency driving mode may be defined as an area equal to or greater than a second grayscale value. In FIG. 18, a size of the converted maximum frequency grayscale area may be represented to W4.

In FIG. 15, the grayscale values equal to or greater than 97 may be driven in the maximum driving frequency of 60 Hz. The input grayscale value of the input image data IMG may be converted into the converted grayscale value by the data remapper 250. In FIG. 17, the input grayscale value of 97 is converted into the converted grayscale value of 88.1. The converted grayscale value of 88.1 is located outside of the maximum frequency grayscale area range (equal to or greater than 97) in FIG. 15. In this way, when the data remapping operation is applied to the input grayscale value of 97 of the input image data IMG, the input grayscale value of 97 of the input image data IMG may be driven in a driving frequency less than the maximum driving frequency of 60 Hz. In FIG. 17, the input grayscale value of 98 is converted into the converted grayscale value of 89.1. The converted grayscale value of 89.1 is located outside of the maximum frequency grayscale area range (equal to or greater than 97) in FIG. 15. In this way, when the data remapping operation is applied to the input grayscale value of 98 of the input image data IMG, the input grayscale value of 98 of the input image data IMG may be driven in a driving frequency less than the maximum driving frequency of 60 Hz. In FIG. 17, the input grayscale value of 105 is converted into the converted grayscale value of 96.1. The converted grayscale value of 96.1 is located outside of the maximum frequency grayscale area range (equal to or greater than 97) in FIG. 15. In this way, when the data remapping operation is applied to the input grayscale value of 105 of the input image data IMG, the input grayscale value of 105 of the input image data IMG may be driven in a driving frequency less than the maximum driving frequency of 60 Hz. In contrast, in FIG. 17, the input grayscale value of 106 is converted into the converted grayscale value of 97.1. The converted grayscale value of 97.1 is located inside of the maximum frequency grayscale area range (equal to or greater than 97) in FIG. 15. Thus, although the data remapping operation is applied to the input grayscale value of 106 of the input image data IMG, the input grayscale value of 106 of the input image data IMG may be driven in the maximum driving frequency of 60 Hz.

As explained above, the second grayscale value defining the converted maximum frequency grayscale area W4 may be 106. As a result, the graph of the driving frequency according to the input grayscale values of the input image data IMG of FIG. 15 is converted into the graph of the driving frequency according to the input grayscale values of the input image data IMG of FIG. 18 by the data remapping operation of the data remapper 250. Thus, the maximum frequency grayscale area corresponding to the maximum driving frequency in the low frequency driving mode may decrease by the data remapping operation of the data remapper 250.

According to the present example embodiment, the driving frequency is determined according to the image displayed on the display panel 100 so that power consumption of the display apparatus may be reduced. In addition, the driving frequency is determined using the flicker value of the image on the display panel 100 so that the flicker of the image may be prevented and the display quality of the display panel 100 may be enhanced. In addition, the high frequency driving grayscale area which is driven in the high driving frequency to prevent the flicker may be decreased by the data remapping method so that power consumption of the display apparatus may be further reduced.

Figure 19:
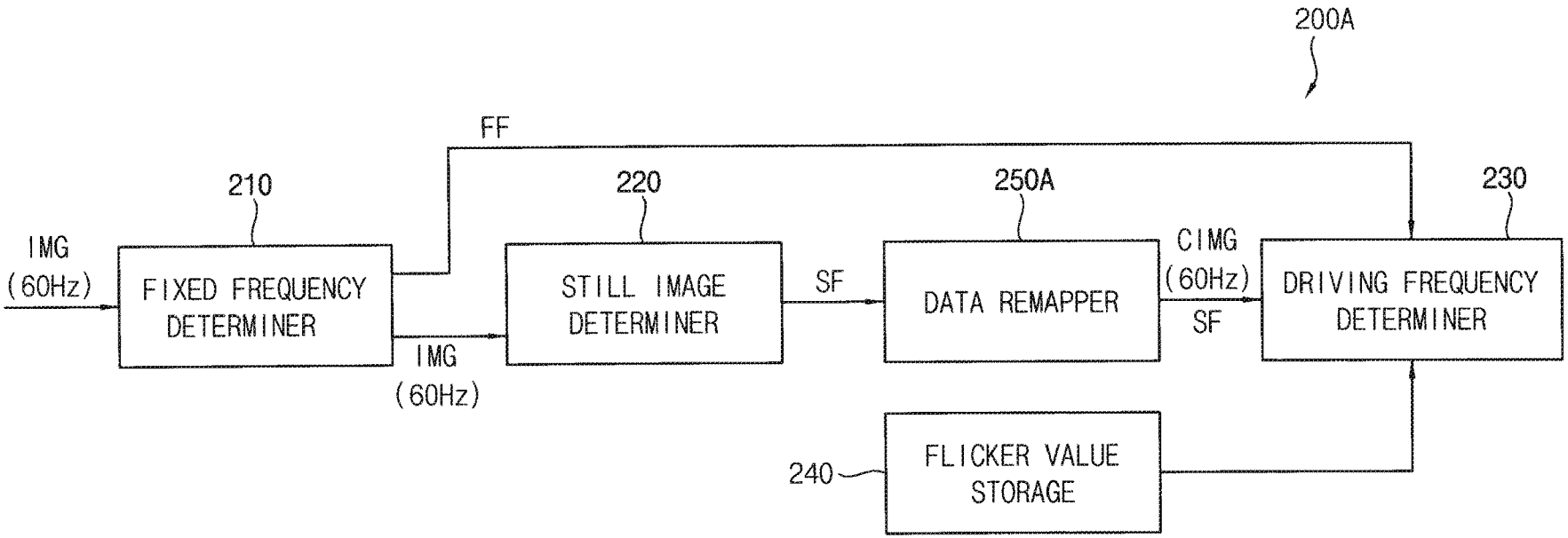
FIG. 19 is a block diagram illustrating a driving controller of a display apparatus according to an example embodiment of the present disclosure.

FIG. 19 is a block diagram illustrating a driving controller 200A of a display apparatus according to an example embodiment of the present disclosure.

The display apparatus and the method of driving the display panel according to the present example embodiment is substantially equal to the display apparatus and the method of driving the display panel of the previous example embodiment explained referring to FIGS. 1 to 12 except for the structure of the driving controller. Thus, the same reference numerals will be used to refer to the same or like parts as those described in the previous example embodiment of FIGS. 1 to 12 and any repetitive explanation concerning the above elements will be omitted.

Referring to FIGS. 1, 3 to 12 and 19, the driving controller 200A may include a still image determiner 220, a driving frequency determiner 230, a flicker value storage 240 and a data remapper 250A. The driving controller 200 may further include a fixed frequency determiner 210.

In the present example embodiment, the data remapper 250A may be formed as a logic unit not as a lookup table.

In the present example embodiment, the data remapper 250A may receive the flag SF and the input image data IMG from the still image determiner 220. The data remapper 250A may multiply a converting gain to the input grayscale value of the input image data IMG to generate a converted grayscale value. The data remapper 250A may output a converted image data CIMG having the converted grayscale value to the driving frequency determiner 230.

For example, the data remapper 250A may extract a luminance component from the grayscale value of the input image data IMG, may multiply a luminance compensating gain to the extracted luminance component to generate a converted luminance component and may generate the converted grayscale value based on the converted luminance component.

For example, the input image data IMG may be defined in a RGB color space. The data remapper 250A may convert the input image data IMG having the RGB color space into the input image data IMG having a YCbCr color space. Alternatively, the data remapper 250A may convert the input image data IMG having the RGB color space into the input image data IMG having a YCoCg color space. The data remapper 250A may extract the luminance component of the input image data IMG from the input image data IMG having the YCbCr color space or the YCoCg color space.

The data remapper 250A may multiply the luminance compensating gain to the luminance component (Y component) of the input image data IMG to generate the compensated luminance component. The data remapper 250A may convert the image data having the YCbCr color space or the YCoCg color space to which the compensated luminance component is reflected into the image data having the RGB color space to generate the converted image data CIMG.

The data remapper 250A may multiply the luminance converting gain to generate the converted image data CIMG so that color coordinates of the converted image data CIMG may be maintained.

The driving controller 200A of the present exemplary embodiment may be applied to the embodiment of FIGS. 13 to 18.

According to the present example embodiment, the driving frequency is determined according to the image displayed on the display panel 100 so that the power consumption of the display apparatus may be reduced. In addition, the driving frequency is determined using the flicker value of the image on the display panel 100 so that the flicker of the image may be prevented and the display quality of the display panel 100 may be enhanced. In addition, the high frequency driving grayscale area which is driven in the high driving frequency to prevent the flicker may be decreased by the data remapping method so that power consumption of the display apparatus may be further reduced.

Figure 20:
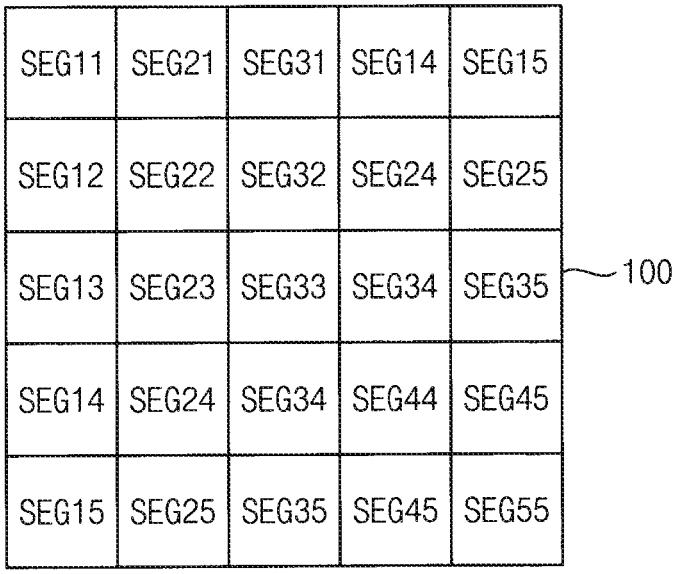
FIG. 20 is a conceptual diagram illustrating a display panel of a display apparatus according to an example embodiment of the present disclosure.
Figure 21:
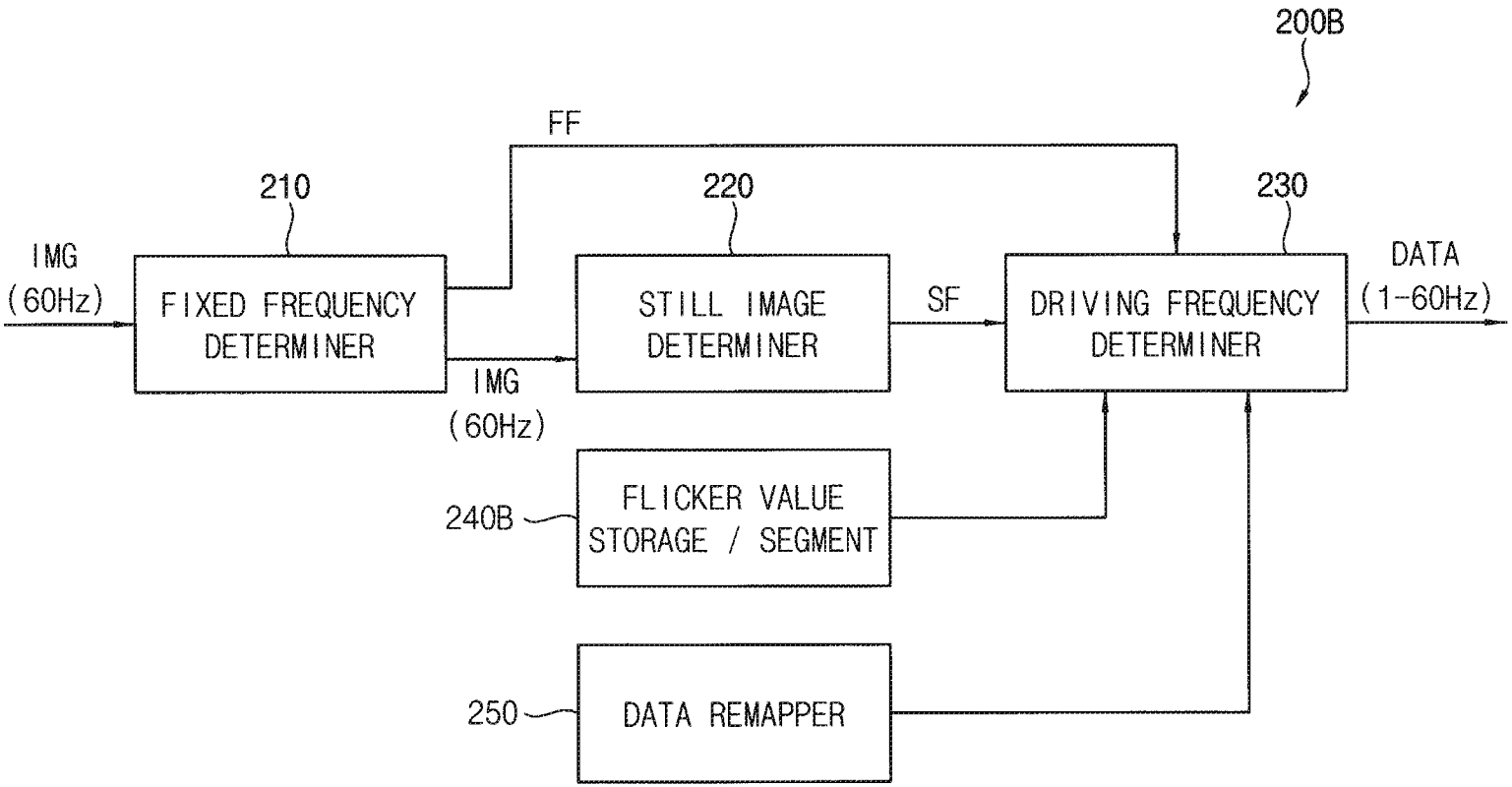
FIG. 21 is a block diagram illustrating a driving controller of the display apparatus of FIG. 20.

FIG. 20 is a conceptual diagram illustrating a display panel 100 of a display apparatus according to an example embodiment of the present disclosure. FIG. 21 is a block diagram illustrating a driving controller 200B of the display apparatus of FIG. 20.

The display apparatus and the method of driving the display panel according to the present exemplary embodiment is substantially equal to the display apparatus and the method of driving the display panel of the previous example embodiment explained referring to FIGS. 1 to 12 except that the display panel is divided into a plurality of segments. Thus, the same reference numerals will be used to refer to the same or like parts as those described in the previous example embodiment of FIGS. 1 to 12 and any repetitive explanation concerning the above elements will be omitted.

Referring to FIG. 20, the display panel 100 may include a plurality of segments SEG11 to SEG55. Although the display panel 100 includes the segments in a five by five matrix in the present example embodiment, the present inventive concept is not limited.

When the flicker value is determined for a unit of the pixel and only one pixel has a high flicker value, the entire display panel may be driven in a high driving frequency to prevent the flicker in the one pixel. For example, when a flicker of only one pixel is prevented in the driving frequency of 30 Hz and the other pixels do not generate the flicker in the driving frequency of 1 Hz, the display panel 100 may be driven in the driving frequency of 30 Hz and the power consumption of the display apparatus may be higher than necessary.

Thus, when the display panel 100 is divided into the segments and the flicker value is determined for a unit of the segment, the power consumption of the display apparatus may be effectively reduced.

The driving controller 200B may determine optimal driving frequencies for the segments and may determine the maximum driving frequency among the optimal driving frequencies for the segments as the low driving frequency of the display panel 100.

For example, when an optimal driving frequency for a first segment SEG11 is 10 Hz and optimal driving frequencies for the other segments SEG12 to SEG55 except for the first segment SEG11 are 2 Hz, the driving controller 200B may determine the low driving frequency to 10 Hz.

As depicted in FIG. 21, the driving controller 200B may include a still image determiner 220, a driving frequency determiner 230, a flicker value storage 240B, and a data remapper 250. The driving controller 200B may further include a fixed frequency determiner 210.

The driving frequency determiner 230 may refer the flicker value storage 240B and information of the segment of the display panel 100 to determine the low driving frequency.

The driving controller 200B of the present example embodiment may be applied to the embodiment of FIGS. 13 to 18.

According to the present example embodiment, the driving frequency is determined according to the image displayed on the display panel 100 so that the power consumption of the display apparatus may be reduced. In addition, the driving frequency is determined using the flicker value of the image on the display panel 100 so that the flicker of the image may be prevented and the display quality of the display panel 100 may be enhanced. In addition, the high frequency driving grayscale area which is driven in the high driving frequency to prevent the flicker may decrease by the data remapping method so that the power consumption of the display apparatus may be further reduced.

In operation, a method of driving a display panel comprises a step of selectively determining a driving mode of a display apparatus among one of a normal driving mode and a low frequency driving mode, a step of converting a grayscale value of input image data to decrease a size of a maximum frequency grayscale area corresponding to a maximum driving frequency in the low frequency driving mode, a step of determining a driving frequency of the display panel using a flicker value storage configured to store a flicker value for the grayscale value of the input image data, a step of outputting a gate signal to the display panel based on the driving frequency, and a step of outputting a data voltage to the display panel based on the driving frequency.

Particularly, the step of the determining the driving frequency comprises a step of determining whether the input image data is a still image or a video image, a step of generating a flag representing whether the input image data is the still image or the video image, a step of determining the driving mode of the display apparatus among one of the normal driving mode and the low frequency driving mode based on the flag, and a step of determining the driving frequency of the display panel using the flicker value storage.

More particularly, the step of the converting the grayscale value of input image data comprises a step of extracting a luminance component from the grayscale value of the input image data, a step of multiplying a luminance compensating gain to the extracted luminance component of the input image data to generate a compensated luminance component, and a step of generating the converted grayscale value based on the compensated luminance component.

According to the present disclosure as explained above, power consumption of the display apparatus may be reduced and the display quality of the display panel may be enhanced.

The foregoing is illustrative of the present disclosure and is not to be construed as limiting. Although a few example embodiments of the present disclosure have been described, those skilled in the art will readily appreciate that many modifications are possible in the example embodiments without materially departing from the novel teachings and advantages of the present disclosure. Accordingly, all such modifications are intended to be included within the scope of the present disclosure as defined in the claims. In the claims, means-plus-function clauses are intended to cover the structures described herein as performing the recited function and not only structural equivalents but also equivalent structures. Therefore, it is to be understood that the foregoing is illustrative of the present disclosure and is not to be construed as limited to the specific example embodiments disclosed, and that modifications to the disclosed example embodiments, as well as other example embodiments, are intended to be included within the scope of the appended claims. The present disclosure is defined by the following claims, with equivalents of the claims to be included therein.

What is claimed is:

1. A display apparatus comprising:

a display panel configured to display an image based on input image data;

a gate driver configured to output a gate signal to the display panel;

a data driver configured to output a data voltage to the display panel; and a driving controller configured to control an operation of the gate driver and an operation of the data driver, to selectively determine a driving mode of the display apparatus between a normal driving mode and a low frequency driving mode, and to determine a driving frequency of the display panel based on the input image data, wherein the driving controller comprises:

a flicker value storage configured to store flicker values for grayscale values of the input image data; and a data remapper configured to convert the grayscale value of the input image data to decrease a size of a maximum frequency grayscale area corresponding to a maximum driving frequency in the low frequency driving mode, wherein grayscale values in the maximum frequency grayscale area are driven in the maximum driving frequency in the low frequency driving mode.

2. The display apparatus of claim 1, wherein the driving controller further comprises:

a still image determiner configured to determine whether the input image data is a still image or a video image based on the input image data, and configured to generate a flag representing whether the input image data is the still image or the video image; and a driving frequency determiner configured to selectively determine the driving mode of the display apparatus between the normal driving mode and the low frequency driving mode based on the flag, and configured to determine the driving frequency of the display panel using the flicker value storage.

3. The display apparatus of claim 2, wherein the data remapper is configured to convert the grayscale value of the input image data when the input image data is the still image, and wherein the data remapper is configured not to convert the grayscale value of the input image data when the input image data is the video image.

4. The display apparatus of claim 3, wherein the data remapper includes a data remapping lookup table configured to generate a converted grayscale value by multiplying a converting gain to the grayscale value of the input image data.

5. The display apparatus of claim 4, wherein the flicker value storage and the data remapping lookup table are formed in a same memory.

6. The display apparatus of claim 3, wherein the data remapper is configured to receive the flag and the grayscale value of the input image data from the still image determiner, configured to multiply a converting gain to the grayscale value of the input image data to generate a converted grayscale value, and configured to output the converted grayscale value to the driving frequency determiner.

7. The display apparatus of claim 6, wherein the data remapper is configured to extract a luminance component from the grayscale value of the input image data, configured to multiply a luminance compensating gain to the extracted luminance component of the input image data to generate a compensated luminance component, and configured to generate the converted grayscale value based on the compensated luminance component.

8. The display apparatus of claim 2, wherein the driving controller further comprises a fixed frequency determiner configured to determine whether an input frequency of the input image data has a normal type by counting a number of pulses of a horizontal synchronizing signal between a first pulse and a second pulse of a vertical synchronizing signal or by counting a number of pulses of a data enable signal between the first pulse and the second pulse of the vertical synchronizing signal.

9. The display apparatus of claim 8, wherein the fixed frequency determiner is configured to generate a frequency flag representing whether the input frequency of the input image data has the normal type or not, and wherein the driving frequency determiner is configured to determine the driving frequency of the display panel.

10. The display apparatus of claim 1, wherein the maximum frequency grayscale area is defined as an area equal to or greater than a first grayscale value and equal to or less than a second grayscale value, wherein a converted maximum frequency grayscale area which is converted by the driving controller is defined as an area equal to or greater than a third grayscale value and equal to or less than a fourth grayscale value, wherein the third grayscale value is greater than the first grayscale value, and wherein the fourth grayscale value is less than the second grayscale value.

11. The display apparatus of claim 10, wherein a converting gain to generate the converted maximum frequency grayscale area is less than 1 in a first converting area and greater than 1 in a second converting area.

12. The display apparatus of claim 1, wherein the maximum frequency grayscale area is defined as an area equal to or greater than a first grayscale value, wherein a converted maximum frequency grayscale area which is converted by the driving controller is defined as an area equal to or greater than a second grayscale value, and wherein the second grayscale value is greater than the first grayscale value.

13. The display apparatus of claim 12, wherein a converting gain to generate the converted maximum frequency grayscale area is equal to or less than 1.

14. The display apparatus of claim 1, wherein the display panel comprises a plurality of segments in a matrix form, and wherein the driving controller is configured to determine the driving frequency of the display panel based on optimal driving frequencies for the segments.

15. A method of driving a display panel, the method comprising:

selectively determining a driving mode of a display apparatus between a normal driving mode and a low frequency driving mode;

converting a grayscale value of input image data to decrease a size of a maximum frequency grayscale area corresponding to a maximum driving frequency in the low frequency driving mode;

determining a driving frequency of the display panel using a flicker value storage configured to store a flicker value for the grayscale value of the input image data;

outputting a gate signal to the display panel based on the driving frequency; and outputting a data voltage to the display panel based on the driving frequency, wherein grayscale values in the maximum frequency grayscale area are driven in the maximum driving frequency in the low frequency driving mode.

16. The method of claim 15, wherein the determining the driving frequency comprises:

selectively determining whether the input image data is a still image or a video image;

generating a flag representing whether the input image data is the still image or the video image;

selectively determining the driving mode of the display apparatus between the normal driving mode and the low frequency driving mode based on the flag; and determining the driving frequency of the display panel using the flicker value storage.

17. The method of claim 16, wherein the grayscale value of the input image data is converted when the input image data is the still image, and wherein the grayscale value of the input image data is not converted when the input image data is the video image.

18. The method of claim 17, wherein the converting the grayscale value of input image data comprises generating a converted grayscale value by multiplying a converting gain to the grayscale value of the input image data.

19. The method of claim 18, wherein the converting the grayscale value of input image data comprises:

extracting a luminance component from the grayscale value of the input image data;

multiplying a luminance compensating gain to the extracted luminance component of the input image data to generate a compensated luminance component; and generating the converted grayscale value based on the compensated luminance component.

20. The method of claim 15, further comprising determining whether an input frequency of the input image data has a normal type by counting a number of pulses of a horizontal synchronizing signal between a first pulse and a second pulse of a vertical synchronizing signal or by counting a number of pulses of a data enable signal between the first pulse and the second pulse of the vertical synchronizing signal.

* * * * *